US009320951B2

(12) United States Patent
Duncan et al.

(10) Patent No.: US 9,320,951 B2
(45) Date of Patent: Apr. 26, 2016

(54) ACTIVE GOLF TEE

(71) Applicant: Elwha, LLC, Bellevue, WA (US)

(72) Inventors: William D. Duncan, Kirkland, WA (US); Roderick A. Hyde, Redmond, WA (US); Thomas A. Weaver, San Mateo, CA (US); Lowell L. Wood, Jr., Bellevue, WA (US)

(73) Assignee: ELWHA LLC, Bellevue, WA (US)

( * ) Notice: Subject to any disclaimer, the term of this patent is extended or adjusted under 35 U.S.C. 154(b) by 101 days.

(21) Appl. No.: 13/968,288

(22) Filed: Aug. 15, 2013

(65) Prior Publication Data

US 2015/0051021 A1 Feb. 19, 2015

(51) Int. Cl.

| | |
|---|---|
| ***A63B 57/10*** | (2015.01) |
| ***A63B 69/36*** | (2006.01) |
| ***A63B 57/00*** | (2015.01) |
| ***A63B 24/00*** | (2006.01) |
| ***A63B 69/00*** | (2006.01) |
| *A63B 69/40* | (2006.01) |

(52) U.S. Cl.

CPC ..... *A63B 57/0018* (2013.01); *A63B 24/0003* (2013.01); *A63B 24/0006* (2013.01); *A63B 24/0021* (2013.01); *A63B 57/10* (2015.10); *A63B 69/0075* (2013.01); *A63B 2024/0031* (2013.01); *A63B 2069/0077* (2013.01); *A63B 2069/402* (2013.01); *A63B 2209/08* (2013.01); *A63B 2220/20* (2013.01); *A63B 2220/30* (2013.01); *A63B 2220/35* (2013.01); *A63B 2220/72* (2013.01); *A63B 2220/74* (2013.01); *A63B 2220/75* (2013.01); *A63B 2220/76* (2013.01); *A63B 2220/78* (2013.01); *A63B 2220/806* (2013.01); *A63B 2220/807* (2013.01); *A63B 2220/89* (2013.01); *A63B 2225/50* (2013.01); *A63B 2225/54* (2013.01)

(58) Field of Classification Search

CPC ..... A63B 57/00; A63B 57/0018; A63B 57/0043; A63B 57/10; A63B 57/12; A63B 57/15; A63B 57/16; A63B 69/36; A63B 57/0006

USPC ..... D21/717, 718

See application file for complete search history.

(56) References Cited

U.S. PATENT DOCUMENTS

| | | | | |
|---|---|---|---|---|
| 1,679,579 | A | 8/1928 | Lundy | |
| 2,011,203 | A * | 8/1935 | Seiki | 473/396 |

(Continued)

OTHER PUBLICATIONS

"Power Tee Demo"; published on You Tube; bearing a date of Jun. 8, 2011; printed on Oct. 27, 2015; 2 pages; located at: https://www.youtube.com/watch?v=vs35c0soE4A.

*Primary Examiner* — Steven Wong

(57) ABSTRACT

Disclosed is a golf tee configured to control spin imparted on a golf ball due to friction between a contact surface of the golf tee and the golf ball. In one embodiment, the golf tee includes a plurality of support members to support a golf ball, wherein contact between the golf ball and the plurality of support members is asymmetrically distributed between a first contact area and a second contact area. In another embodiment, the golf tee includes a two-part shaft slideably coupled together and an adjustable resistance mechanism to provide a resistive force between the two parts of the golf tee, wherein the resistive force opposes the sliding together of the two parts. The resistance mechanism may be manually or automatically to control spin imparted to the golf ball due to friction between a contact surface of the golf tee and the golf ball.

4 Claims, 34 Drawing Sheets

(56) References Cited

U.S. PATENT DOCUMENTS

| | | | | | |
|---|---|---|---|---|---|
| 2,643,883 | A | | 6/1953 | Hogeberg | |
| 2,696,985 | A | | 12/1954 | Hogeberg | |
| 3,469,454 | A | | 9/1969 | Cornell | |
| 3,533,631 | A | | 10/1970 | Hladek | |
| 3,947,027 | A | | 3/1976 | Brown | |
| 4,103,888 | A | | 8/1978 | Ricketts | |
| 4,367,879 | A | | 1/1983 | Messer | |
| 4,418,909 | A | | 12/1983 | Messana | |
| 4,786,054 | A | | 11/1988 | Keys | |
| 4,787,637 | A | * | 11/1988 | Lima et al. | 473/396 |
| 5,193,803 | A | * | 3/1993 | Flick, III | 473/392 |
| 5,242,170 | A | | 9/1993 | Ward | |
| 5,301,950 | A | * | 4/1994 | Patterson | 473/278 |
| 5,738,598 | A | * | 4/1998 | Wu | 473/392 |
| D404,448 | S | * | 1/1999 | Lawrence | D21/718 |
| 5,984,808 | A | | 11/1999 | Fleischer | |
| 6,083,122 | A | | 7/2000 | Brown | |
| 6,120,383 | A | | 9/2000 | Brown | |
| 6,139,449 | A | | 10/2000 | Cardarelli | |
| 6,328,663 | B1 | | 12/2001 | Lipstock | |
| 6,344,003 | B1 | | 2/2002 | Choung | |
| 6,500,077 | B1 | | 12/2002 | Wei | |
| D482,086 | S | * | 11/2003 | Metz | D21/718 |
| D492,743 | S | * | 7/2004 | Boyarko | D21/717 |
| D559,926 | S | * | 1/2008 | Wood | D21/718 |
| 7,604,554 | B2 | | 10/2009 | Otsubo | |
| 7,780,551 | B2 | | 8/2010 | Wood et al. | |
| 8,029,387 | B2 | | 10/2011 | Breton | |
| 8,083,615 | B2 | | 12/2011 | Wood et al. | |
| 2001/0009870 | A1 | | 7/2001 | Hammerquist | |
| 2002/0198066 | A1 | | 12/2002 | Salsman | |
| 2004/0067802 | A1 | | 4/2004 | Salsman | |
| 2005/0124438 | A1 | | 6/2005 | Breton | |
| 2005/0148410 | A1 | * | 7/2005 | DeLisle et al. | 473/387 |
| 2005/0181893 | A1 | | 8/2005 | Slaven | |
| 2005/0192110 | A1 | | 9/2005 | Regev | |
| 2005/0245330 | A1 | | 11/2005 | Gustine | |
| 2005/0261089 | A1 | | 11/2005 | Homby | |
| 2006/0052175 | A1 | | 3/2006 | Faltin | |
| 2006/0079350 | A1 | | 4/2006 | Lu et al. | |
| 2006/0100037 | A1 | | 5/2006 | Pels | |
| 2006/0211519 | A1 | | 9/2006 | Breton | |
| 2007/0111825 | A1 | | 5/2007 | Lee | |
| 2007/0129177 | A1 | * | 6/2007 | Harris | 473/387 |
| 2007/0232417 | A1 | | 10/2007 | DeLisle et al. | |
| 2008/0045358 | A1 | | 2/2008 | VanDelden | |
| 2008/0182684 | A1 | | 7/2008 | Carroll et al. | |
| 2009/0084008 | A1 | | 4/2009 | Middleton et al. | |
| 2009/0118041 | A1 | * | 5/2009 | Manson | 473/387 |
| 2009/0137345 | A1 | | 5/2009 | Sagadevan | |
| 2009/0181806 | A1 | | 7/2009 | Wood et al. | |
| 2009/0191983 | A1 | | 7/2009 | Otsubo | |
| 2009/0233734 | A1 | | 9/2009 | Wood et al. | |
| 2009/0264224 | A1 | | 10/2009 | Whitehouse | |
| 2009/0275426 | A1 | | 11/2009 | DeLisle et al. | |
| 2009/0325726 | A1 | | 12/2009 | Humphrey | |
| 2010/0173731 | A1 | * | 7/2010 | Schneider | 473/403 |
| 2010/0179003 | A1 | | 7/2010 | Steinhobel | |
| 2010/0279798 | A1 | | 11/2010 | Wood et al. | |
| 2011/0256964 | A1 | * | 10/2011 | Li et al. | 473/387 |
| 2011/0319198 | A1 | | 12/2011 | Breton | |
| 2012/0028735 | A1 | | 2/2012 | Klein | |
| 2012/0065000 | A1 | | 3/2012 | DeLisle et al. | |
| 2012/0077625 | A1 | | 3/2012 | Passero | |
| 2012/0165136 | A1 | | 6/2012 | Durham et al. | |
| 2012/0214616 | A1 | | 8/2012 | Lipstock et al. | |
| 2013/0130819 | A1 | | 5/2013 | Kwong | |
| 2013/0331206 | A1 | | 12/2013 | Kumar | |
| 2014/0371006 | A1 | | 12/2014 | Black, Jr. et al. | |

* cited by examiner

ACTIVE GOLF TEE

If an Application Data Sheet (ADS) has been filed on the filing date of this application, it is incorporated by reference herein. Any applications claimed on the ADS for priority under 35 U.S.C. §§119, 120, 121, or 365(c), and any and all parent, grandparent, great-grandparent, etc. applications of such applications, are also incorporated by reference, including any priority claims made in those applications and any material incorporated by reference, to the extent such subject matter is not inconsistent herewith.

CROSS-REFERENCE TO RELATED APPLICATIONS

The present application is related to and/or claims the benefit of the earliest available effective filing date(s) from the following listed application(s) (the "Priority applications"), if any, listed below (e.g., claims earliest available priority dates for other than provisional patent applications or claims benefits under 35 USC §119(e) for provisional patent applications, for any and all parent, grandparent, great-grandparent, etc. applications of the Priority application(s)). In addition, the present application is related to the "Related applications," if any, listed below.

PRIORITY APPLICATIONS

NONE

RELATED APPLICATIONS

U.S. patent application Ser. No. 13/968,284, entitled ACTIVE GOLF TEE, naming William D. Duncan, Roderick A. Hyde, Thomas A. Weaver, and Lowell L. Wood, Jr. as inventors, filed 15 Aug. 2013, respectively, is related to the present application.

U.S. patent application Ser. No. 13/968,285, entitled ACTIVE GOLF TEE, naming William D. Duncan, Roderick A. Hyde, Thomas A. Weaver, and Lowell L. Wood, Jr. as inventors, filed 15 Aug. 2013, respectively, is related to the present application.

The United States Patent Office (USPTO) has published a notice to the effect that the USPTO's computer programs require that patent applicants reference both a serial number and indicate whether an application is a continuation, continuation-in-part, or divisional of a parent application. Stephen G. Kunin, Benefit of Prior-Filed application, USPTO Official Gazette Mar. 18, 2003. The USPTO further has provided forms for the Application Data Sheet which allow automatic loading of bibliographic data but which require identification of each application as a continuation, continuation-in-part, or divisional of a parent application. The present Applicant Entity (hereinafter "Applicant") has provided above a specific reference to the application(s) from which priority is being claimed as recited by statute. Applicant understands that the statute is unambiguous in its specific reference language and does not require either a serial number or any characterization, such as "continuation" or "continuation-in-part," for claiming priority to U.S. patent applications. Notwithstanding the foregoing, Applicant understands that the USPTO's computer programs have certain data entry requirements, and hence Applicant has provided designation(s) of a relationship between the present application and its parent application(s) as set forth above and in any ADS filed in this application, but expressly points out that such designation(s) are not to be construed in any way as any type of commentary and/or admission as to whether or not the present application contains any new matter in addition to the matter of its parent application(s).

If the listings of applications provided above are inconsistent with the listings provided via an ADS, it is the intent of the Applicant to claim priority to each application that appears in the Priority applications section of the ADS and to each application that appears in the Priority applications section of this application.

All subject matter of the Priority applications and the Related applications and of any and all parent, grandparent, great-grandparent, etc. applications of the Priority applications and the Related applications, including any priority claims, is incorporated herein by reference to the extent such subject matter is not inconsistent herewith.

SUMMARY

The present disclosure, in various example embodiments, provides systems and methods associated with a golf tee configured to impart a spin to a golf ball prior to impact between the golf ball and the golf club face. The golf tee includes a retention mechanism configured to releasably secure a golf ball to a contact surface of the golf tee while a rotation mechanism rotates the golf tee or a spin mechanism spins the golf ball, thereby imparting spin to the golf ball. The golf tee may further include a processing unit configured to control the retention mechanism and rotation mechanism or spin mechanism. The processing unit may communicate with various external or local sensors, for example, a swing sensor, an environmental sensor, or the like, to control the golf tee to spin the golf ball to achieve a particular post impact trajectory.

The present disclosure, in other example embodiments, provides systems and methods associated with a golf tee configured to reduce or eliminate spin imparted on a golf ball due to friction between a contact surface of the golf tee and the golf ball. In one embodiment, the golf tee includes a retracting mechanism to retract the support member of the golf tee prior to impact between the golf club face and the golf ball, at least one swing sensor to measure motion parameters of an approaching golf club, and a processing unit to control the retracting mechanism based on the measured motion parameters. In another embodiment, the golf tee includes a contactless support mechanism to support the golf ball, a position sensor to detect a position of the golf ball, and a processing unit to control the support mechanism, based on data from the position sensor, to manipulate the position of the golf ball.

The present disclosure, in other example embodiments, provides systems and methods associated with a golf tee configured to control spin imparted on a golf ball due to friction between a contact surface of the golf tee and the golf ball. In one embodiment, the golf tee includes a plurality of support members to support a golf ball, wherein contact between the golf ball and the plurality of support members is asymmetrically distributed between a first contact area and a second contact area. In another embodiment, the golf tee includes a two-part shaft slideably coupled together and an adjustable resistance mechanism to provide a resistive force between the two parts of the golf tee, wherein the resistive force opposes the sliding together of the two parts. The resistance mechanism may be manually or automatically to control spin imparted to the golf ball due to friction between a contact surface of the golf tee and the golf ball.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
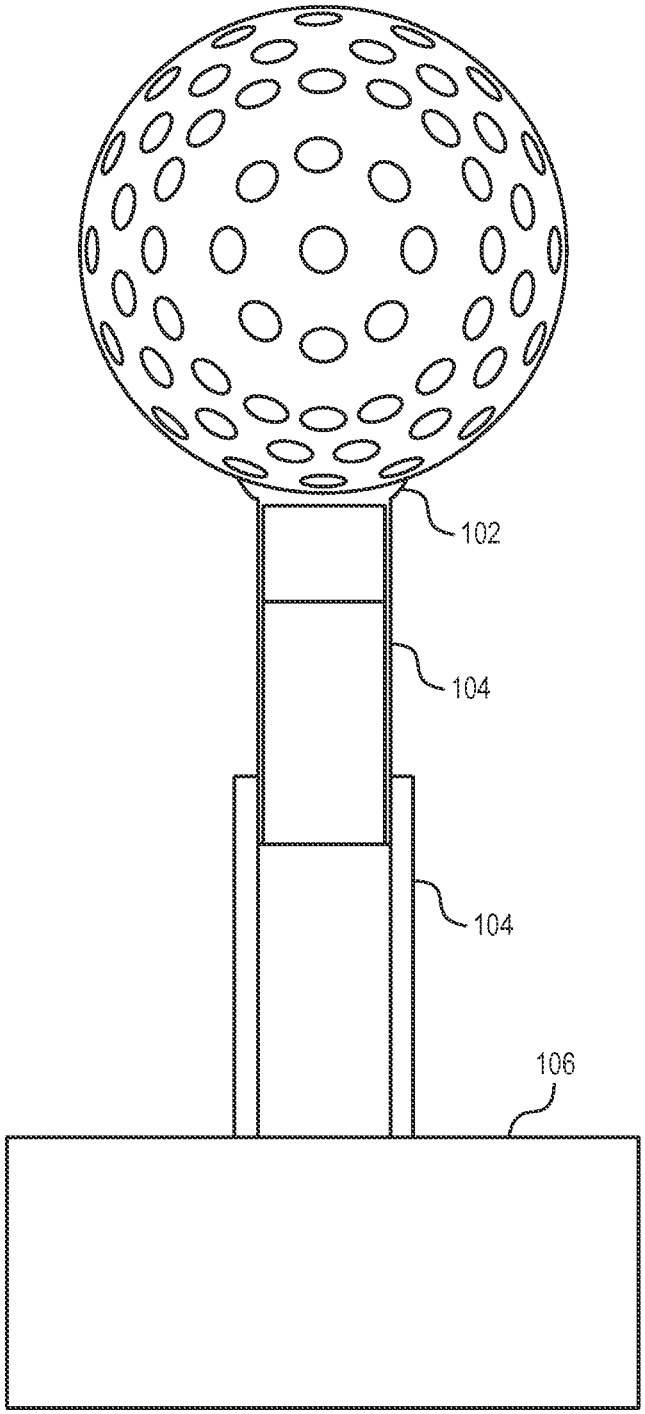
FIG. 1 illustrates an example embodiment of a spinning golf tee.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

One of the main factors controlling a golf ball's trajectory is the spin imparted to a golf ball by a golf club face. Top spin and back spin determines a golf ball's vertical trajectory as well as the distance the ball will roll after landing, while lateral spin determines the golf ball's horizontal trajectory (e.g., hook or slice). Since the tee shot is typically the longest shot on a golf hole, and sets the stage for subsequent shots, the spin imparted to the golf ball on the tee shot is important. Using active and passive golf tee elements, as described in more detail below, the spin, and therefore the trajectory, of a golf ball may be manipulated.

FIG. 1 illustrates an example embodiment of a spinning golf tee. In various embodiments, a spinning golf tee according to the techniques introduced here, may include a contact surface 102, a support member 104, and a rotation mechanism 106. The contact surface 102 may be configured to support a golf ball prior to contact between the golf ball and an approaching golf club face. The top of the support member 104 may be coupled with the contact surface 102 and the bottom of the support member may be coupled with the rotation mechanism 106, such that the rotation mechanism 106 may impart spin to the golf ball by rotating the support member 104. In one embodiment, the rotation mechanism 106 may be configured to rotate the support member 104 around an axis running from the top to the bottom of the support member.

Figure 2:
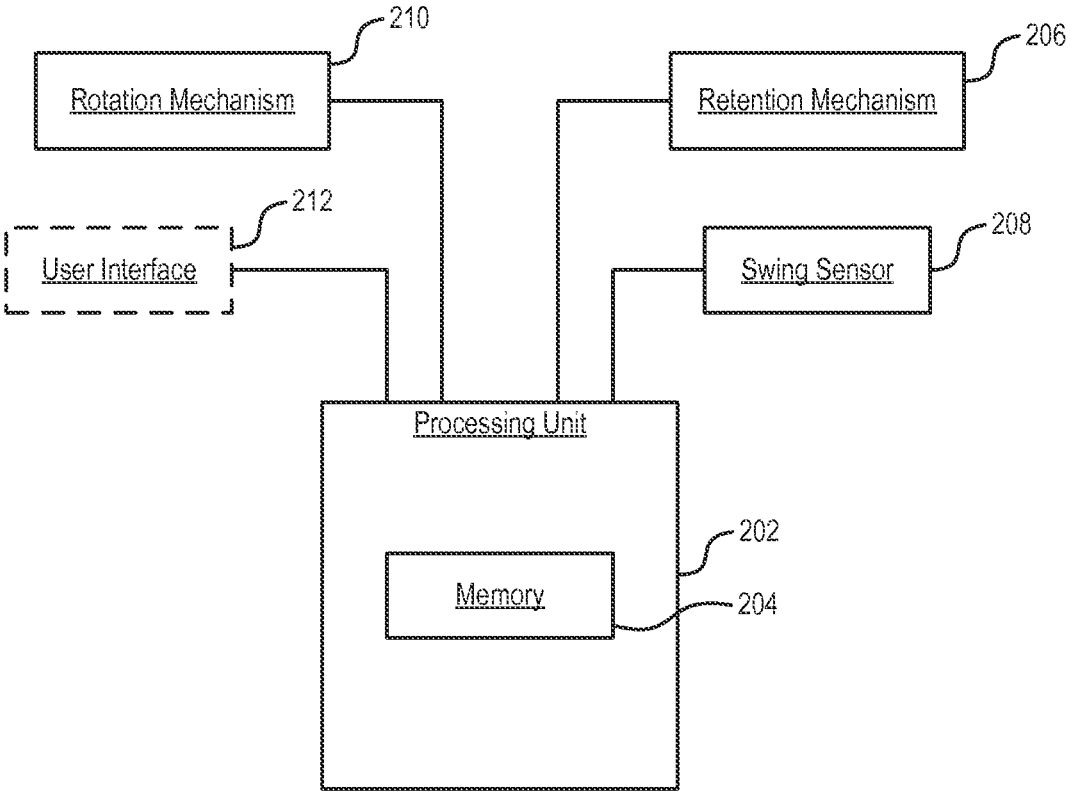
FIG. 2 illustrates a block diagram of a spinning golf tee.

FIG. 2 illustrates a block diagram of a spinning golf tee. In various embodiments, the spinning golf tee may include a processing unit 202 including memory 204, a retention mechanism 206, at least one swing sensor 208, a rotation mechanism 210, and a user interface 212. As shown in the example of FIG. 2, the processing unit 202 may be coupled with, and control the operation of, the retention mechanism 206 and the rotation mechanism 210.

The retention mechanism 206 may be configured to releasably secure the golf ball to the contact surface 102. In various embodiments, described in more detail below, the retention mechanism 206 may be a vacuum, a clamp type retention mechanism including an opposing surface configured to apply pressure on the golf ball toward the contact surface, or the like. Under control of the processing unit 202, the retention mechanism 206 may be configured to release the golf ball prior to contact between the golf ball and an approaching golf club face.

The rotation mechanism 210 may rotate the support member 104, under the control of processing unit 202, to impart spin to the golf ball prior to impact between the golf ball and an approaching golf club face. In various embodiments, the processing unit 202 may determine the rotation of the support member 104 by the rotation mechanism 210 based on various inputs, such as motion parameters of the approaching golf club face, user entered preferences, environmental conditions, or the like. Motion parameters of the approaching golf club face may be measured or determined by one or more swing sensors, such as swing sensor 208.

One application for the spinning golf tee may be for training. For example, a spinning golf tee may be used to accentuate or counteract spin imparted to the golf ball by improper swing mechanics. In one embodiment, the processing unit 202 may determine the rotation of the support member to impart a spin to the golf ball to counteract a spin caused by a swing error of a golfer. In another embodiment, the processing unit 202 may determine the rotation of the support member to impart a spin to the golf ball to accentuate a spin caused by a swing error of a golfer.

The spinning golf tee may likewise be used during course play to assist a golfer in achieving a particular post-impact trajectory for the golf ball. The particular post-impact trajectory may be defined by the desired height of the golf ball flight, the desired left-to-right or right-to-left motion of the golf ball flight, the desired roll distance, etc. The processing unit 202 may determine the rotation (e.g., angular speed and direction) of the support member to impart a spin to the golf ball to achieve the particular post-impact trajectory taking into account motion parameters of the approaching golf club face, environmental conditions, golf course layout, hole location, etc. In one embodiment, the particular post impact trajectory may be manually entered by a golfer through an optional user interface 212.

In various embodiments, the processing unit 202 may include a memory 204. The memory may be used to store parameters for use by the processing unit 202 in calculating an angular speed and direction of spin to impart to the golf ball. For example, the memory may store a golf course layout (or at least a portion of a golf course layout), a location of a golf hole, historical swing characteristics of a golfer, a handicap of a golfer, the angular speed and direction of spin imparted to the golf ball, or the like. As introduced above, the parameters may enable the processing unit 202 to determine an appropriate rotation of the support member to impart a spin to the golf ball to correct for a swing error. For example, the processing unit may calculate an angular speed and direction to rotate the support member based on the handicap of a golfer, where a lower handicap may result in less assistance in correcting a swing error.

Figure 3:
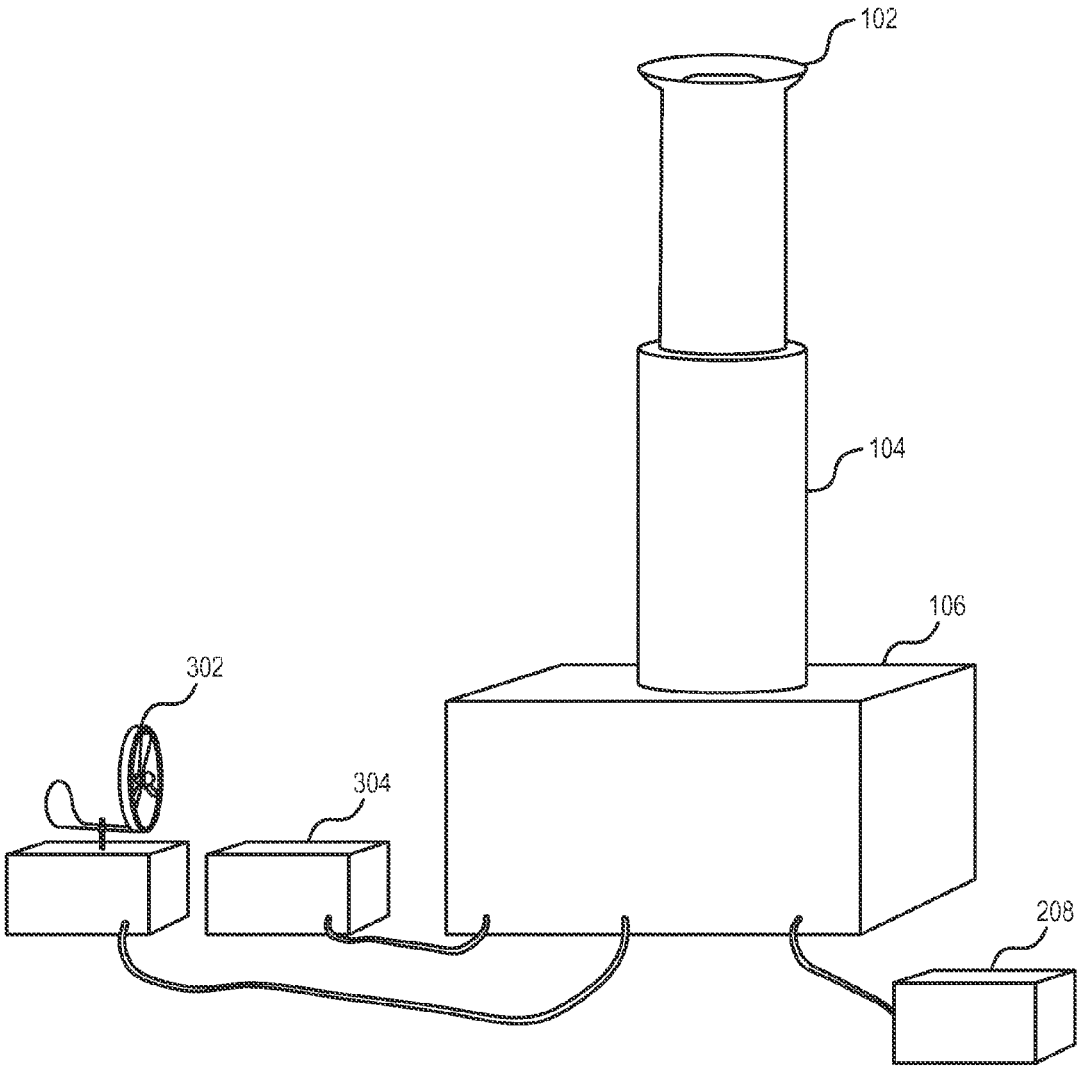
FIG. 3 illustrates an example embodiment of a spinning golf tee including various sensors.

FIG. 3 illustrates an example embodiment of a spinning golf tee including various sensors. In various embodiments, a spinning golf tee, according to the techniques introduced here, may include various sensors such as, for example, a swing sensor 208, an environmental conditions sensor 302, and a golf club sensor 304. The various sensors may be in communication with the processing unit 202 to provide data for use by the processing unit 202 in calculating an angular speed and direction of spin to impart to the golf ball. It should be apparent that each of the sensors depicted in the example of FIG. 3 may be a collection of sensors and other electronics. In various embodiments, the sensors may be remotely located and transmit information to the golf tee for processing.

The swing sensor 208 may be configured to measure motion parameters of the approaching golf club face and communicate the motion parameters to the processing unit 202. The motion parameters measured by the swing sensor 208 may include, for example, a swing speed, a swing trajectory, a club face angle, a predicted impact location on the golf club face, or the like. To measure the motion parameters, the swing sensor may include various motion capture devices, such as a radar unit, a lidar unit, a camera (e.g., a video camera, a fiber-optic camera, a stereoscopic camera, or a still camera), an ultrasound unit, or the like. In another embodiment, (e.g., for training scenarios), components of the swing sensors may be located in or on the golf ball or the golf club. In one embodiment, the swing sensor 208 may include a separate processing unit for processing raw data prior to communicating the motion parameters to the golf tee processing unit 202. In other embodiments, the swing sensor 208 may communicate the raw data to the processing unit 202 for processing to determine the motion parameters.

As discussed above, the processing unit 202 may use the motion parameters to determine an angular speed and direction of spin to impart to the golf ball to compensate for a swing flaw, accentuate a swing flaw, or to achieve a particular post-impact trajectory. In various embodiments, the processing unit 202 may use other parameters stored in the processing unit memory 204 or received from other sensors in addition to the motion parameters of the golf club to determine the angular speed and direction to rotate the support member.

For example, in one embodiment, in addition to the motion parameters, the processing unit may use data from the environmental conditions sensor 302 to determine the angular speed and direction to rotate the support member to achieve a particular post-impact trajectory. The environmental conditions sensor 302 may be configured to measure or receive data on various atmospheric or other environmental conditions such as, air temperature, air pressure, wind speed and direction, precipitation, humidity, or the like. The environmental conditions sensor 302 may further be configured to measure or receive data on course conditions such as grass height, slope, surface wetness, or the like to aid in predicting the reaction of a golf ball after contact with the ground. Therefore, the environmental conditions sensor 302 may be made up of one or more various sensors, such as an anemometer, a wind vane, a wind monitor, a thermometer, a barometer, a rain gauge, a hygrometer, etc.

In another embodiment, the processing unit 202 may use golf club parameters (e.g., club loft, length, etc.) of the approaching golf club in addition to the motion parameters, to determine the angular speed and direction to rotate the support member to achieve the particular post-impact trajectory. In one embodiment, the golfer may be able to specify, through user interface 212, the golf club and/or the golf club parameters. In other embodiments, the system may include a golf club sensor 304 configured to determine golf club parameters with or without user input. The golf club sensor 304 may include, for example, a radio frequency identification (RFID) reader unit configured to read an RFID tag incorporated into or placed on an approaching golf club. The RFID tag may identify the golf club and/or golf club parameters for use by the processing unit 202. In another embodiment, the golf club sensor may include a camera to capture an image of the approaching golf club. The processing unit 202, or a dedicated processing unit for the golf club sensor 304, may then determine the golf club parameters based on the image by, for example, image analysis. Knowledge of the golf club's identity may be used to determine (e.g., via a database) information on other golf club parameters such as shaft length and stiffness, or the mass, size, shape, sweet spot, resiliency, and frictional characteristics of the golf club's face. In various embodiments, the golf club parameters may be used by the processing unit 202, in addition to the other parameters and information provided by the other various sensors in the system to determine the angular speed and direction to rotate the support member to achieve the particular post-impact trajectory.

Figure 4:
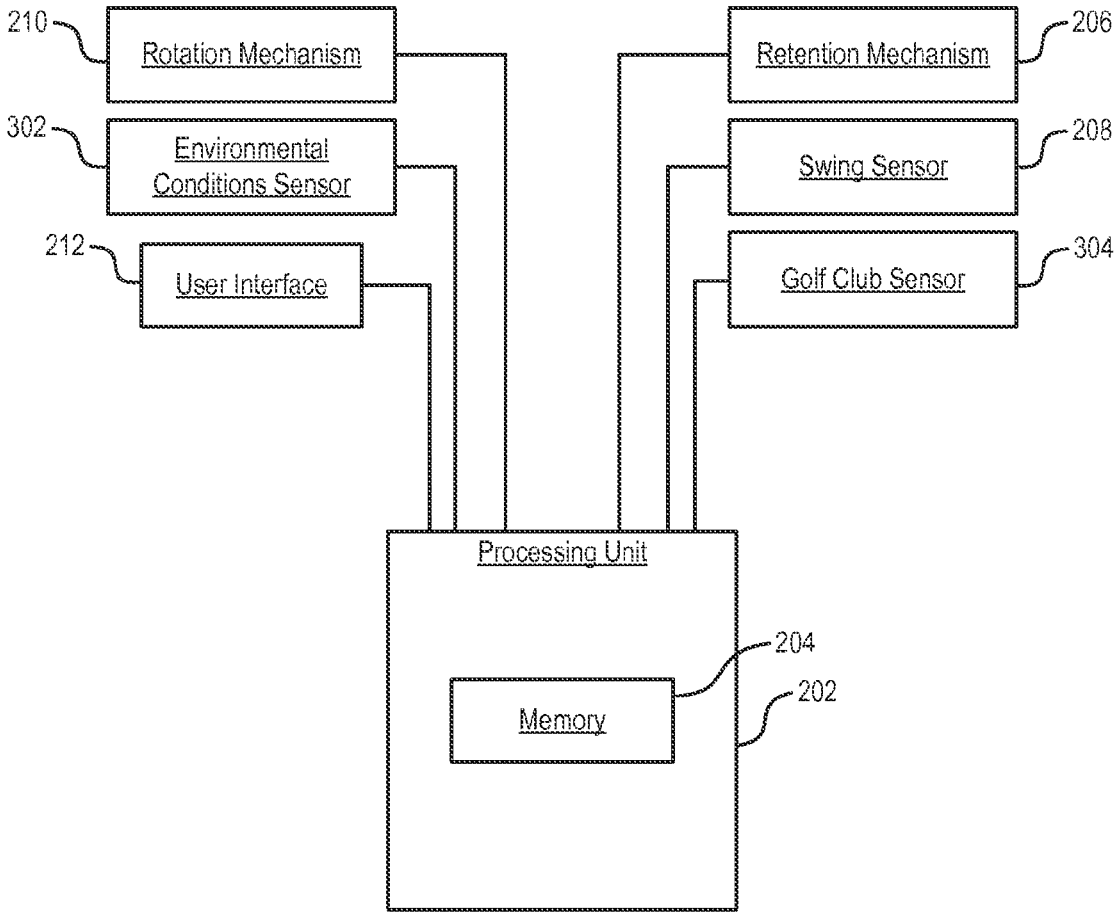
FIG. 4 illustrates a block diagram of a spinning golf tee including various sensors.

FIG. 4 illustrates a block diagram of a spinning golf tee including various sensors. The block diagram illustrated in FIG. 4 depicts the processing unit 202, including processing unit memory 204, coupled with retention mechanism 206, rotation mechanism 210, swing sensor 208, environmental conditions sensor 302, and golf club sensor 304. In various embodiments, the sensors depicted in FIG. 4 may be located near to or remote from the processing unit and/or golf tee.

Figure 5:
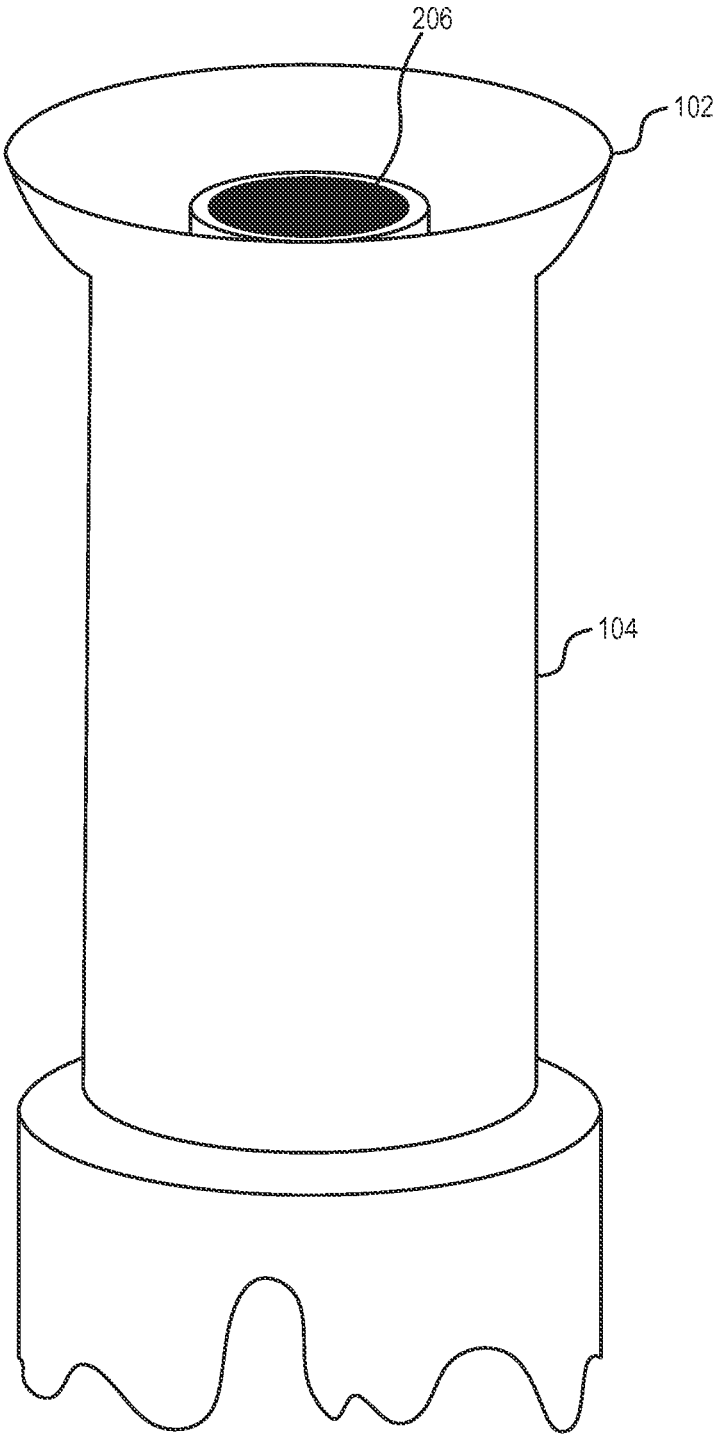
FIG. 5 illustrates an example embodiment of a retention mechanism of a spinning golf tee.

FIG. 5 illustrates an example embodiment of a retention mechanism of a spinning golf tee. As introduced above, the retention mechanism 206 may be configured to releasably secure the golf ball to the contact surface 102. In one embodiment, as illustrated in FIG. 5, the retention mechanism 206 may be a vacuum configured to hold the golf ball in contact with the contact surface 102 until the processing unit 202 indicates for the retention mechanism 206 to release the golf ball. In another embodiment (not shown), the retention mechanism 206 may be an electromagnet configured to hold a magnetically reactive golf ball in contact with the contact surface 102 until the processing unit 202 triggers the retention mechanism 206 to release the golf ball. The magnetically reactive golf ball (e.g., a training ball) may contain ferromagnetic or paramagnetic material in order to interact with the electromagnet.

Figure 6:
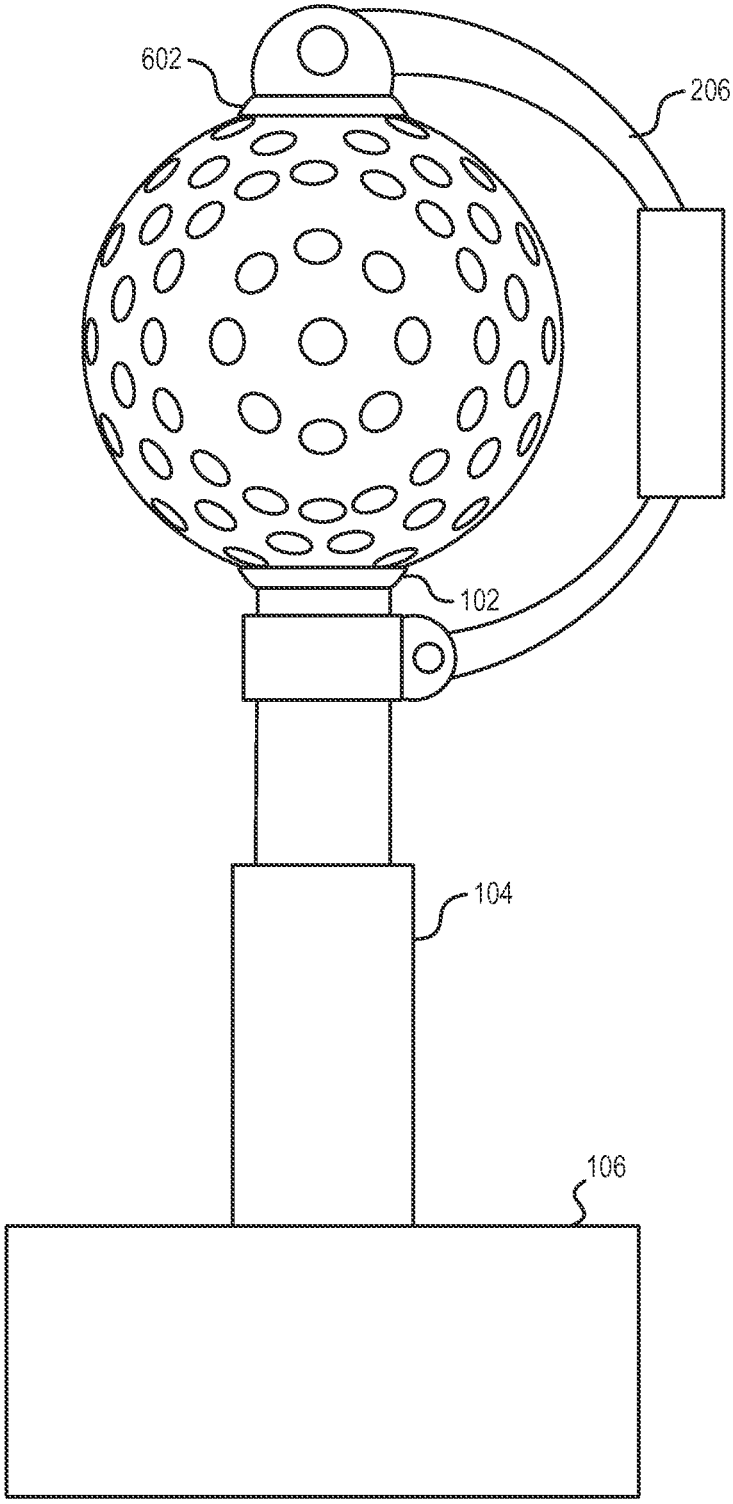
FIG. 6 illustrates an example embodiment of a retention mechanism of a spinning golf tee.

FIG. 6 illustrates an example embodiment of a retention mechanism of a spinning golf tee. In another embodiment, as depicted in the example of FIG. 6, the retention mechanism 206 may be a clamp type retention mechanism having an opposing surface 602 to constrain the golf ball against the contact surface 102. In one embodiment, the opposing surface 602 and the contact surface 102 may use suction provided by a vacuum to grip the golf ball in addition to, or in the place of, compression between the opposing surface 602 and the contact surface 102.

Figure 7:
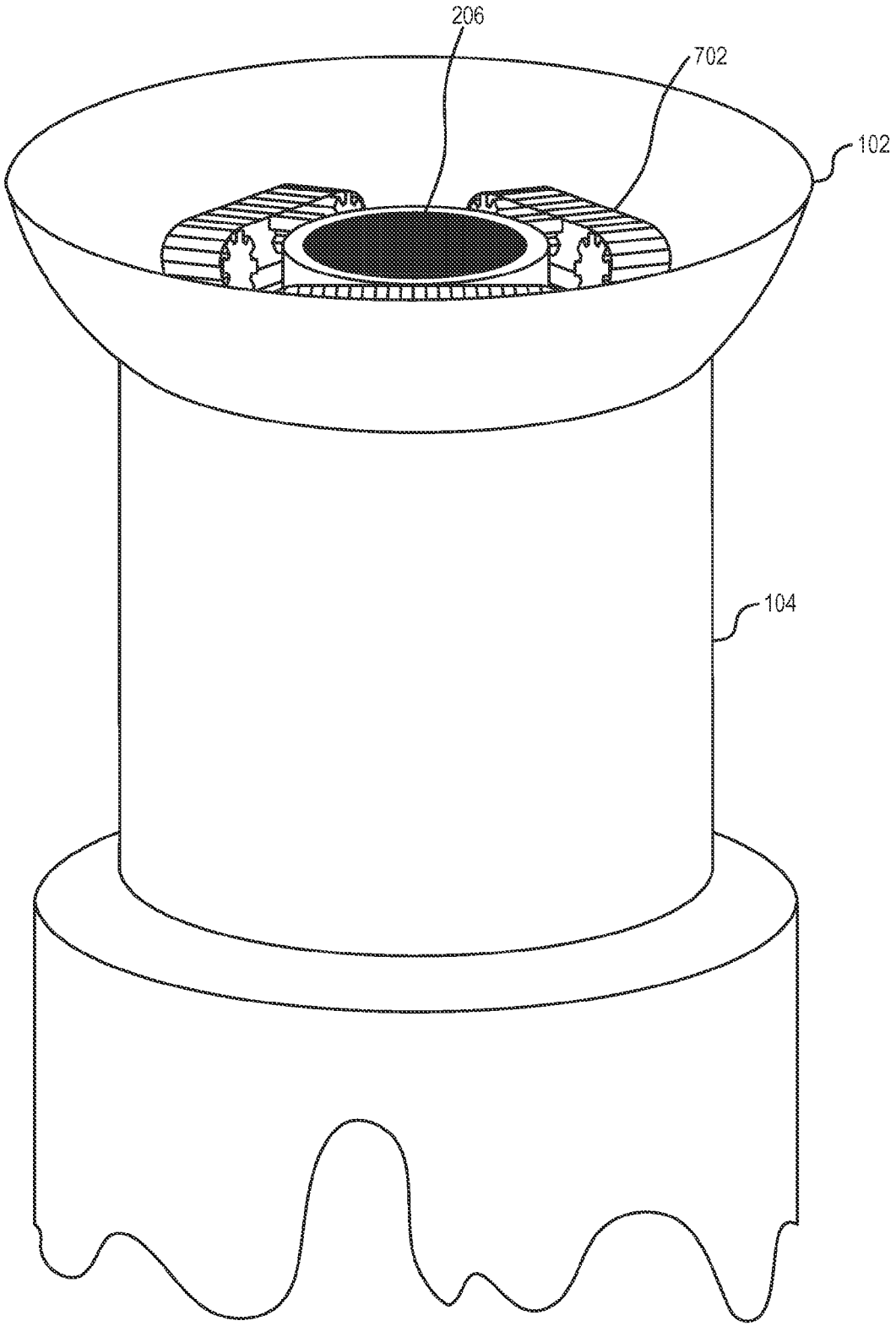
FIG. 7 illustrates an example embodiment of a spin mechanism of a spinning golf tee.

As described above with reference to FIGS. 1 through 6, the golf tee may impart spin to the golf ball by rotating the support member 104 by a rotation mechanism 106. However, other methods of imparting spin to the golf ball may be used. For example, spin may be imparted to a golf ball containing ferromagnetic or paramagnetic materials by one or more electromagnets on or around the golf tee. In another example, spin may be imparted to a golf ball by impacting the surface of the golf ball with gas streams (e.g., air streams tangentially hitting opposing sides of the golf ball). Further, FIG. 7 illustrates another example embodiment of a spin mechanism of a spinning golf tee. In the example of FIG. 7, the golf tee includes a spinning mechanism 702 within, or coupled with, the contact surface 102. The spinning mechanism 702, in addition to being configured to impart spin to the golf ball around and axis running through the top and the bottom of support member 104, may be configured to impart topspin or backspin to the golf ball around a horizontal axis, perpendicular to the axis running through the top and the bottom of the support member 104. Additionally, the spin mechanism 702 may be configured to impart both spins to the golf ball resulting in the golf ball spinning around an inclined axis.

Including spin around the horizontal axis can influence the vertical post-impact trajectory of the golf ball in addition to the horizontal post-impact trajectory that is influenced by imparting spin to the golf ball around the axis running from the top to the bottom of the support member 104. For example, horizontal spin may enable a golfer to achieve a particular post-impact distance by increasing or decreasing the flight apex, ground roll, or the like. As with the examples described above, the spin mechanism 702 may enable a particular post impact trajectory that is entered manually by a user or determined by a processing unit using various inputs and/or parameters. The example of FIG. 7 includes a vacuum type retention mechanism 206 as discussed above.

Figure 8:
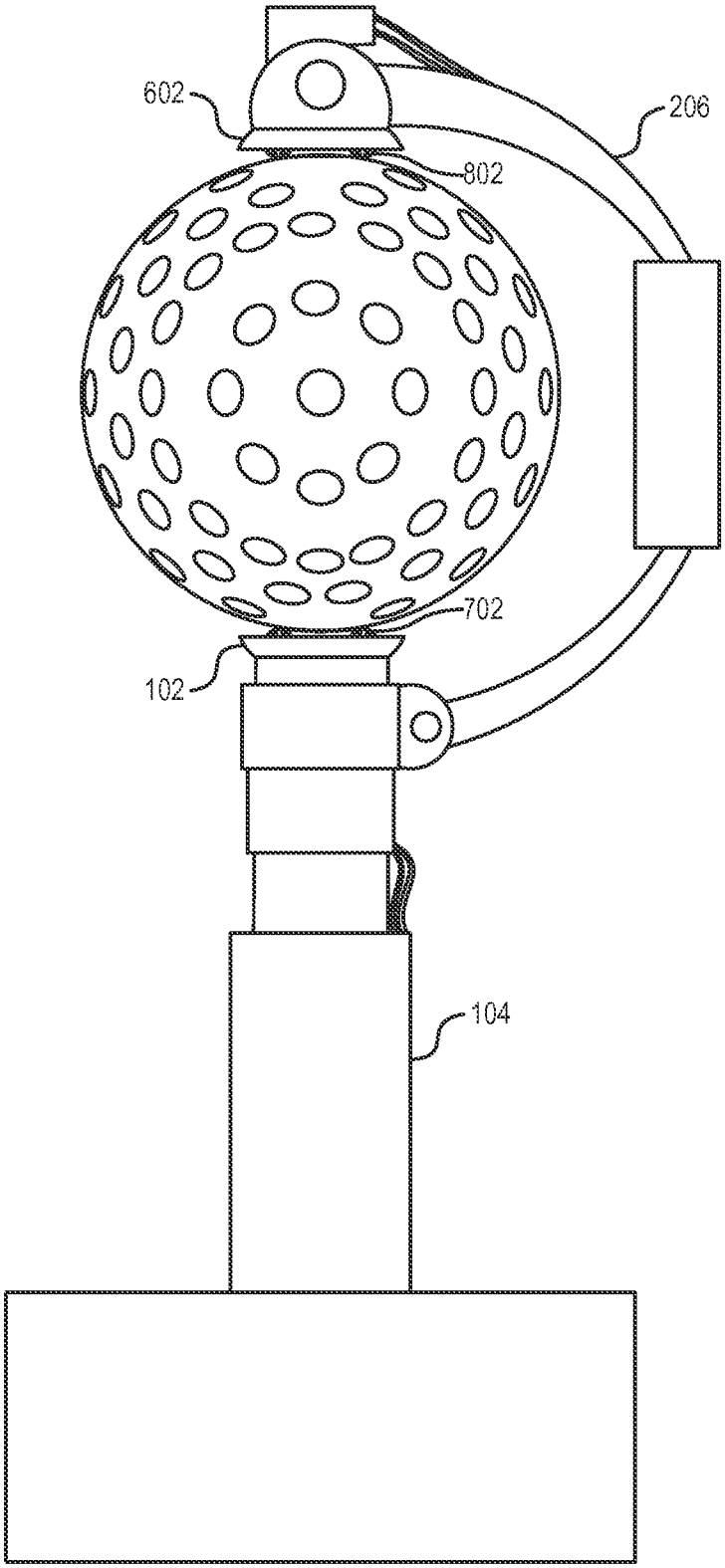
FIG. 8 illustrates an example embodiment of a spin mechanism of a spinning golf tee.

Various other retention mechanism 206 and spin mechanism 706 configurations are considered. For example, FIG. 8 illustrates one example embodiment of a spin mechanism of a spinning golf tee. The retention mechanism 206 in the example of FIG. 8 may be of the clamp type. In various embodiments, a spin mechanism 702 may be included within, or coupled with, the contact surface 102. In addition to, or in place of, a spin mechanism 802 may be included within, or coupled with, the opposing surface 602. While the spin mechanism 702 in the examples of FIGS. 7 and 8 are depicted as a belt or track type mechanism, other various embodiments are considered. For example, the spin mechanism 702 may include rollers, wheels, spheres, or the like. In one embodiment, a golf tee design similar to that shown in the example of FIG. 1 may be used (e.g., in a driving range environment) to deliver spin around a horizontal or an inclined axis by using a correspondingly angled axis for the support member 104 and the rotation mechanism 106.

Figure 9:
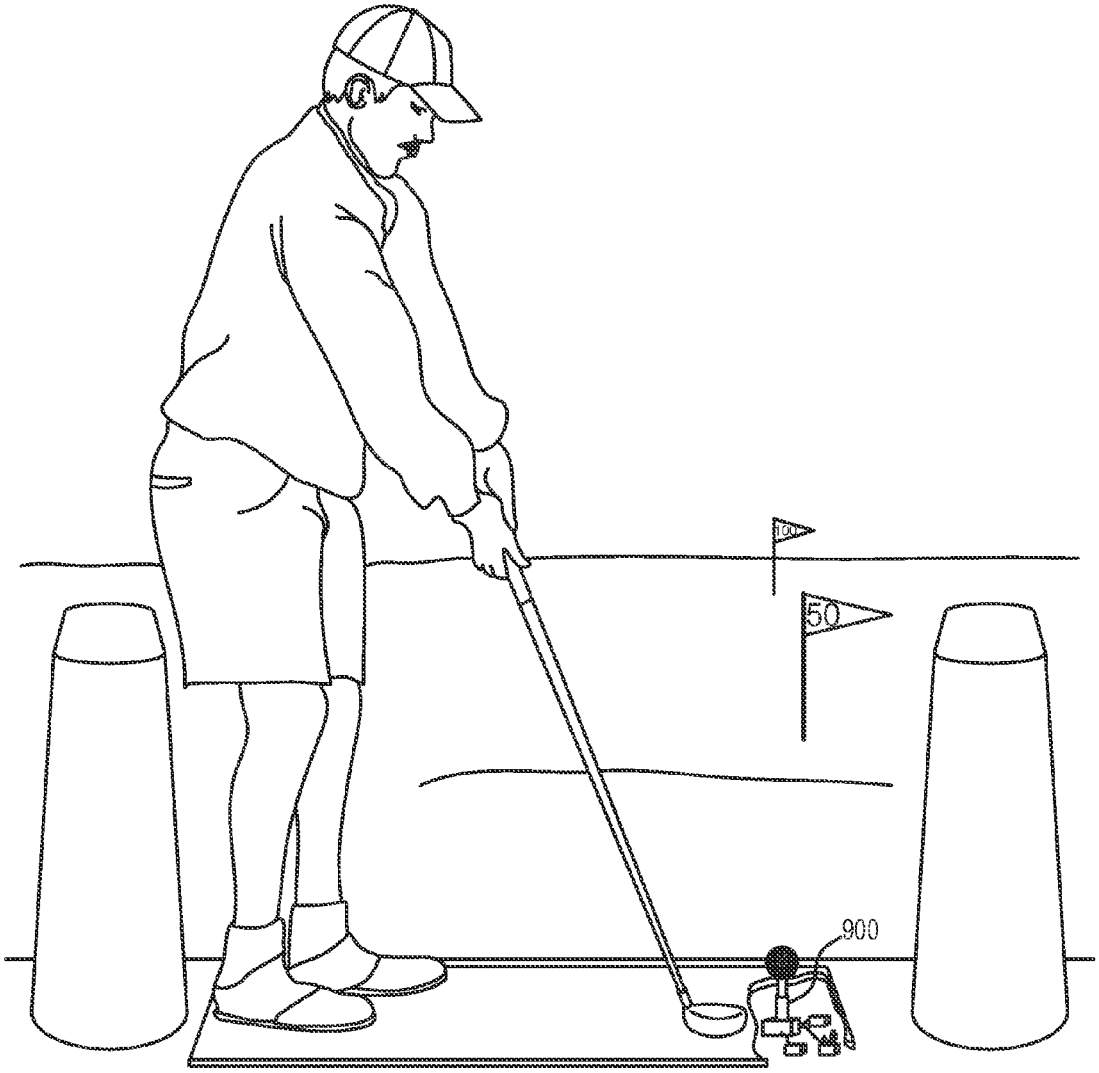
FIG. 9 illustrates an example embodiment of a spinning golf tee within a driving range platform.

FIG. 9 illustrates an example embodiment of a spinning golf tee within a driving range platform. In one embodiment, the spinning golf tee 900 as described above may be disposed within a driving range platform, for example. In the example embodiment of FIG. 9, all of the component parts of the spinning golf tee 900, except for the support member 104 and contact surface 102, may be disposed below ground level, or in a side support on the opposite side of the golf ball from the golfer, so as to not interfere with a golfer's swing. In other embodiments, the various sensors described above may be above or below ground level and coupled with the spinning golf tee via wire or wireless link.

In various embodiments, a spinning golf tee may be disposed within the various teeing grounds of a golf course for use by golfers on tee shots. In one embodiment, the spinning golf tee 900 may include a user interface to allow a golfer to select or enter a profile that links information stored in a memory of the golf tee's 900 processing unit to the golfer. In another embodiment, the golf tee 900 may include an identity detection module, e.g., an RFID reader, that can identify the golfer without requiring the golfer to interact via a user interface.

Figure 10:
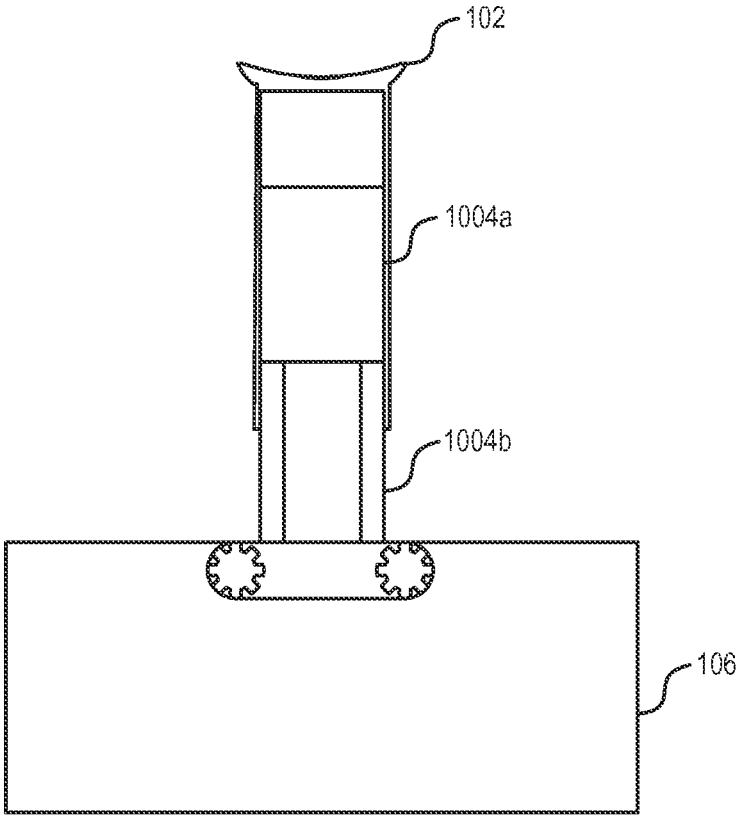
FIG. 10 illustrates an example of a replaceable support member coupled with a rotation mechanism.
Figure 11:
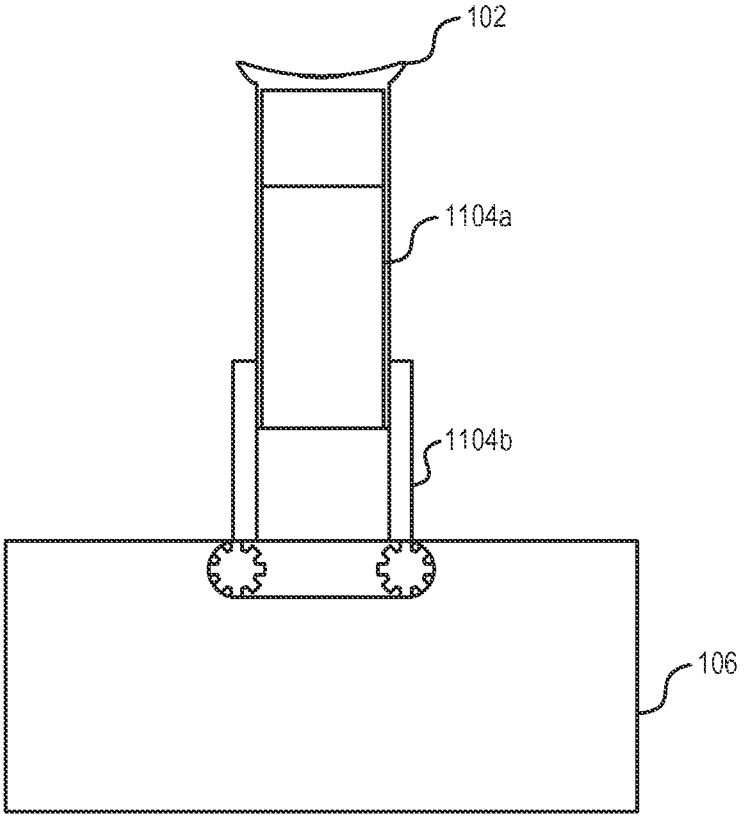
FIG. 11 illustrates an example of a replaceable support member coupled with a rotation mechanism.

Because the contact surface 102 and support member 104 of the golf tee may be repeatedly subjected to impact by a golf club, in various embodiments, at least a portion of the support member 104 may be removable and replaceable. FIGS. 10 and 11 illustrate various examples of a replaceable support member coupled with a rotation mechanism. In the example of FIG. 10, the support member may include a replaceable part 1004*a*, which includes the contact surface 102, and a fixed part 1004*b*, which is coupled with rotation mechanism 106. The fixed part 1004*b* of the support member in the example of FIG. 10 is a post type structure which is configured to receive the replaceable part 1004*a* of the support member which is a sleeve type structure. In the example of FIG. 11, the fixed part 1104*b* of the support member is a sleeve type structure configured to receive the replaceable part 1104*a* of the support member.

Figure 12:
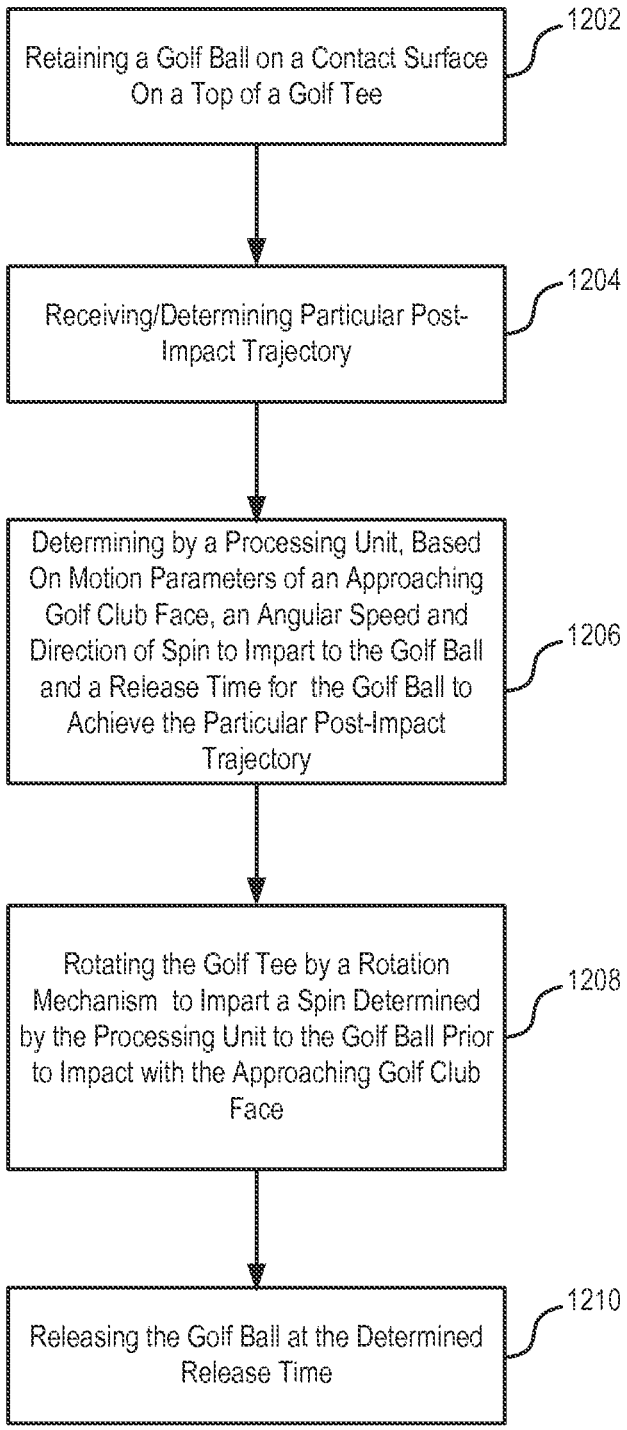
FIG. 12 illustrates an example flow diagram of an example method for using a spinning golf tee to achieve a particular post-impact trajectory based on motion parameters of an approaching golf club face.

FIG. 12 illustrates an example flow diagram of an example method for achieving a particular post-impact trajectory based on motion parameters of an approaching golf club face. At 1202, the method begins by retaining a golf ball on a contact surface, e.g., contact surface 102, on a top of a golf tee. As described above, the golf ball may be retained by creating a vacuum at the contact surface 102, such that the golf ball is retained by to the contact surface 102 by suction. In another embodiment, the golf ball may be retained by constraining the golf ball between the contact surface 102 and an opposing surface 602. In other embodiments, a combination of suction and pressure may be used to retain the golf ball on the contact surface.

At 1204, in some embodiments, a processing unit determines or receives a particular intended post impact trajectory for the golf ball. In one embodiment, the particular post-impact trajectory may be entered by a golfer, for example through a user interface provided by the golf tee. In another embodiment, a processing unit of the golf tee may determine the particular post-impact trajectory based on a desired distance, ground roll, flight apex, or the like entered by a user through the user interface. The user interface may include a keypad, touchscreen, voice recognition system, or the like in communication with the processing unit. Alternatively, the user interface may be embodied in a mobile personal electronic device (e.g., a smartphone or tablet) in communication with the processing unit of the golf tee. In yet another embodiment, the processing unit determines the particular post-impact trajectory based on, for example, a golf course layout, the location of a golf hole, historical swing characteristics of a golfer, environmental conditions, a golfer's handicap, or the like.

At 1206, the processing unit determines, based on motion parameters of an approaching golf club face, an angular speed and direction of spin to impart to the golf ball and a release time for the golf ball to achieve the particular post impact trajectory. In one embodiment, determining the angular speed and direction of spin to impart to the golf ball may include storing at least a portion of a golf course layout in a memory of the processing unit and determining the angular speed and direction to rotate the golf tee to achieve the particular post-impact trajectory based on the golf course layout and the motion parameters of the approaching golf club face.

In other embodiments, determining the angular speed and direction of spin to impart to the golf ball may include storing a location of a golf hole in the memory of the processing unit and determining the angular speed and direction to rotate the golf tee to achieve the particular post-impact trajectory based on the location of the golf hole and the motion parameters of the approaching golf club face. Similarly, determining the angular speed and direction may include storing historical swing characteristics of a golfer, a handicap of a golfer, and using those parameters along with the motion parameters of the approaching golf club face to determine the angular speed and direction to rotate the golf tee to achieve the particular post-impact trajectory. In other embodiments, the processing unit may determine the angular speed to counteract or accentuate spin imparted to the golf ball by a swing error of a golfer.

At 1208, the rotation mechanism rotates the golf tee to impart a spin determined by the processing unit to the golf ball prior to impact with the approaching golf club face. In one embodiment, the rotation mechanism may rotate the golf tee around an axis running from the top of the golf tee to the bottom to impart a left-to-right or right-to-left spin to the golf ball. In other embodiments, a spin mechanism may rotate the golf around a vertical, horizontal, or inclined axis based to achieve the particular post-impact trajectory.

At 1210, the retention mechanism releases the golf ball at the determined release time. The processing unit may determine the release time based on motion parameters of the approaching golf club. For example, the processing unit may determine a time of contact between the golf ball and the approaching golf club face and set the release time as the time of contact.

Figure 13:
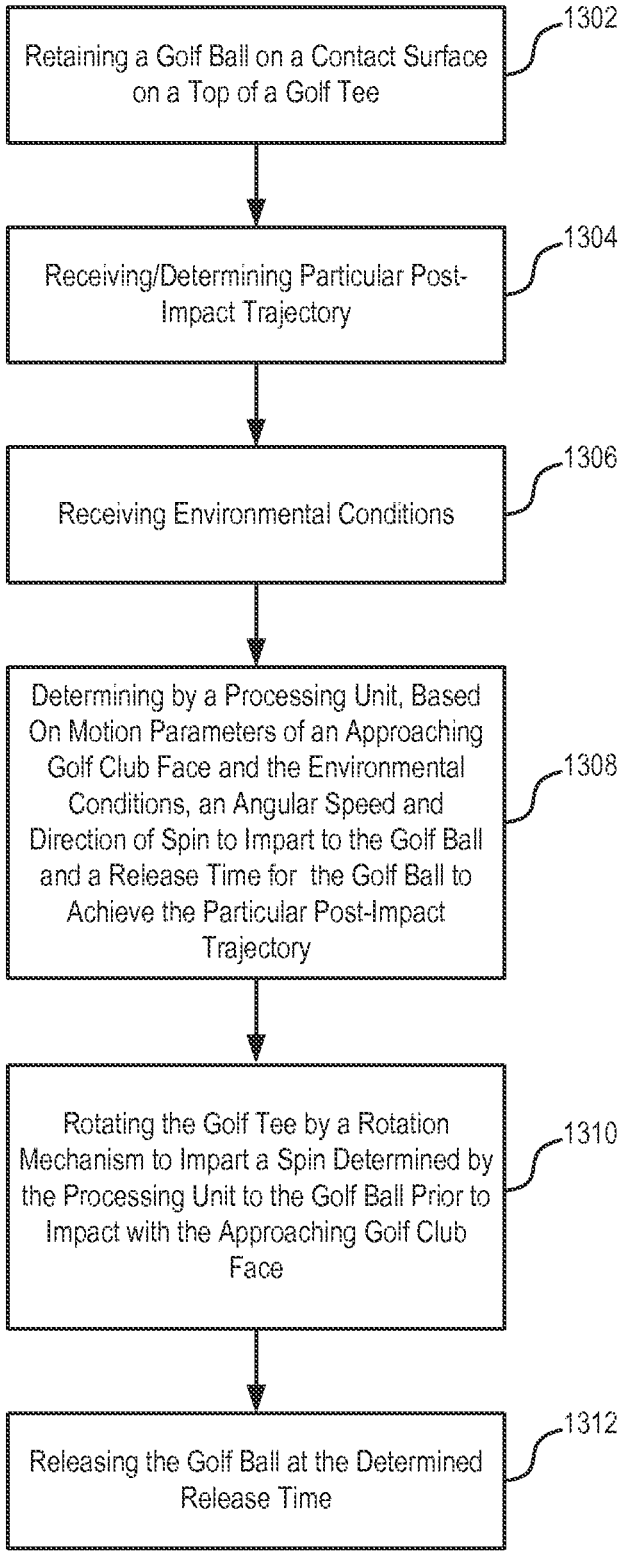
FIG. 13 illustrates an example flow diagram of an example method for using a spinning golf tee to achieve a particular post-impact trajectory based on motion parameters of an approaching golf club face and environmental conditions.

FIG. 13 illustrates an example flow diagram of an example method for using a spinning golf tee to achieve a particular post-impact trajectory based on motion parameters of an approaching golf club face and environmental conditions. The method begins at 1302 by retaining a golf ball on a contact surface on a top of a golf tee. Retaining the golf ball may be accomplished as described above with regard to 1202 of FIG. 12. The method continues at 1304 with receiving or determining a particular post-impact trajectory for the golf ball as described in detail above with regard to 1204 of FIG. 12.

At 1306, the method continues with the processing unit of the golf tee receiving environmental conditions. In one embodiment, the processing unit is coupled with one or more environmental conditions sensors, such as an anemometer, a wind vane, a wind monitor, a thermometer, a barometer, a rain gauge, a hygrometer, or the like. The environmental conditions sensors may detect current environmental conditions and communicate them to the processing unit for use in determining a angular speed and direction of spin to impart to the golf ball to achieve the particular post-impact trajectory. In another embodiment, the processing unit may receive environmental conditions from an external source, for example, a national or local weather service, private weather reports, or the like.

At 1308, the method continues with determining by a processing unit, based on motion parameters of an approaching golf club face and the environmental conditions, an angular speed and direction of spin to impart to the golf ball and a release time for the golf ball to achieve the particular post-impact trajectory. In one embodiment, determining the angular speed and direction of spin to impart to the golf ball may include storing at least a portion of a golf course layout in a memory of the processing unit and determining the angular speed and direction to rotate the golf tee to achieve the particular post-impact trajectory based on the golf course layout, the environmental conditions, and the motion parameters of the approaching golf club face.

In other embodiments, determining the angular speed and direction of spin to impart to the golf ball may include storing a location of a golf hole in the memory of the processing unit and determining the angular speed and direction to rotate the golf tee to achieve the particular post-impact trajectory based on the location of the golf hole, the environmental conditions, and the motion parameters of the approaching golf club face. Similarly, determining the angular speed and direction may include storing historical swing characteristics of a golfer, a handicap of a golfer, and using those parameters along with the environmental conditions and motion parameters of the approaching golf club face to determine the angular speed and direction to rotate the golf tee to achieve the particular post-impact trajectory.

At 1310 the method continues with rotating the golf tee by a rotation mechanism to impart the spin determined by the processing unit to the golf ball prior to impact between the golf ball and the approaching golf club face. At 1312 the method continues by releasing the golf ball at the determined release time. The actions associated with 1310 and 1312 may be performed as described above with reference to 1208 and 1210 of FIG. 12, respectively.

Figure 14:
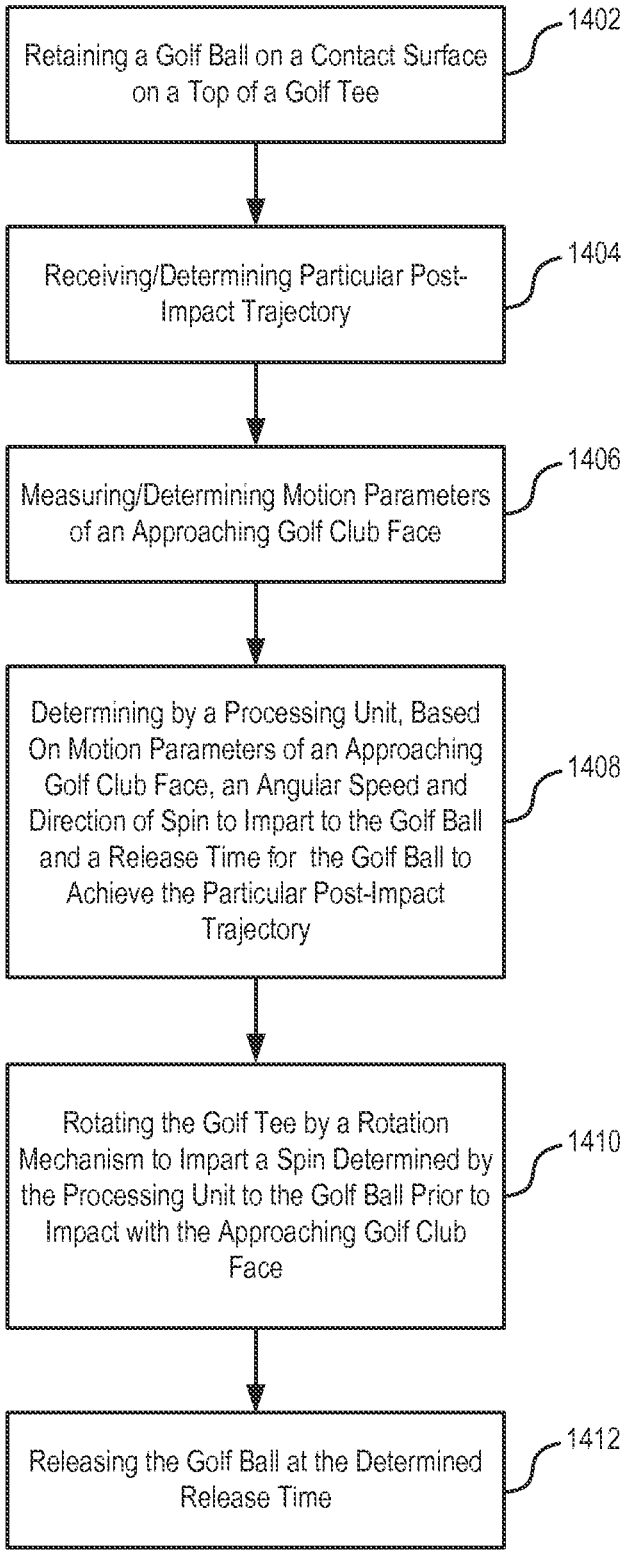
FIG. 14 illustrates an example flow diagram of an example method for using a spinning golf tee to achieve a particular post-impact trajectory based on measured motion parameters of an approaching golf club face.

FIG. 14 illustrates an example flow diagram of an example method for using a spinning golf tee to achieve a particular post-impact trajectory based on measured motion parameters of an approaching golf club face. The method begins at 1402 by retaining a golf ball on a contact surface on a top of a golf tee. Retaining the golf ball may be accomplished as described above with regard to 1202 of FIG. 12. The method continues at 1404 with receiving or determining a particular post-impact trajectory for the golf ball as described in detail above with regard to 1204 of FIG. 12.

At 1406 the method continues with measuring or determining motion parameters of the approaching golf club face. In one embodiment, the motion parameters of the approaching golf club face may be measured or determined by one or more swing sensors coupled with the processing unit. The one or more swing sensors may be, for example, various motion capture or detection devices, such as a radar unit, a lidar unit, a camera (e.g., a video camera, a fiber-optic camera, a stereoscopic camera, or a still camera), an ultrasound unit, or the like. In some embodiments, using a processing unit dedicated for the one or more swing sensors or the processing unit of the golf tee, a swing speed, swing trajectory, current and/or projected club face angle, predicted impact location on the golf club face, or other motion parameters may be determined from data provided by the one or more swing sensors.

In other embodiments, in addition to, or in place of, the data provided by the one or more motion sensors, the processing unit may determine motion parameters of the golf club face based on golf club parameters (e.g., club face loft, shaft length, shaft flex, club weight, etc.) associated with the approaching golf club face. In one embodiment, the golf club parameters may be entered manually by a golfer. In other embodiments, the golf tee may determine the golf club parameters by at least one golf club sensor, for example an RFID reader, a camera, or the like.

In one embodiment, determining motion parameters of the approaching golf club face may be performed by the processing unit based on historical swing characteristics of the golfer. To determine the motion parameters, the processing unit memory may store a profile for the golfer which includes historical swing data. Using the historical swing data, the processing unit may determine, for example, an average swing speed, club face angle, approach angle, or the like for the approaching golf club face and use the averages as the motion parameters of the approaching golf club face.

In the examples of FIGS. 12-14, the processing unit may store in a memory the angular speed and direction of spin that was imparted to the golf ball prior to impact with the approaching golf club face. This spin may be associated with a golfer profile and may be used in later calculations, such as scoring a round of golf, calculating the golfer's handicap, or determining angular speed and direction of spin to impart to the golf ball on subsequent occasions.

Spin imparted to a golf by a golf club face is not the only spin imparted to the golf ball that may affect the trajectory of the golf ball. As the golf ball is impacted by the golf club face, the golf ball deforms and pushes against the contact surface of the golf tee where the friction between the golf ball and the contact surface imparts spin to the golf ball. Therefore, it would be desirable to reduce or eliminate the friction between the golf ball and the contact surface of the golf tee in order to reduce or eliminate the spin imparted to the golf ball.

In one embodiment, the golf tee may be retracted, prior to contact between the golf club face and the golf ball, such that the golf ball is inertially suspended in the air upon contact. Because there is no longer contact between the golf ball and the contact surface of the golf tee at impact between the golf ball and the golf club face, unwanted spin is not imparted to the golf ball.

Figure 15:
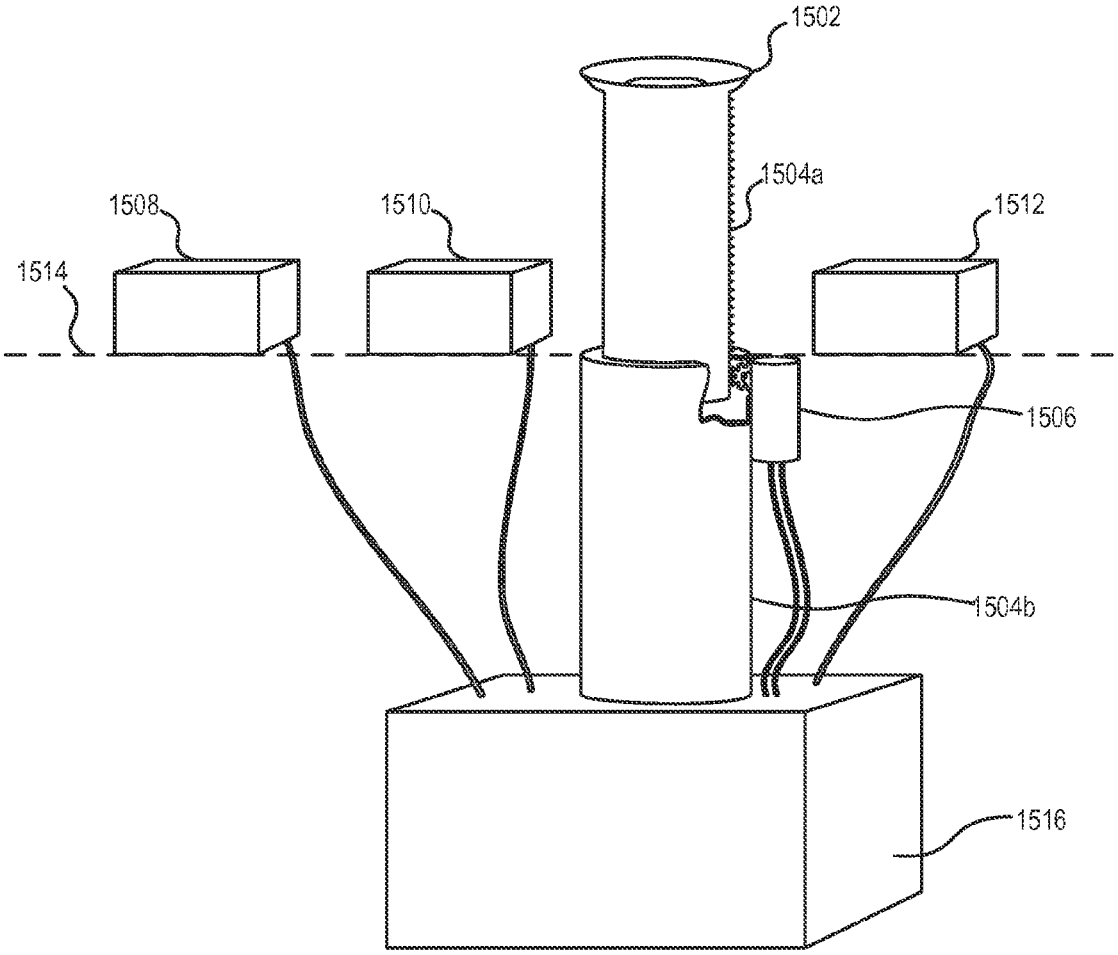
FIG. 15 illustrates an example embodiment of a retracting golf tee.

FIG. 15 illustrates an example embodiment of a retracting golf tee. In some embodiments, as shown in the example of FIG. 15, the retracting golf tee may include a contact surface 1502, a support member 1504, a retracting mechanism 1506, a swing sensor 1508, an impact sensor 1510, and a golf ball sensor 1512. The contact surface 1502 may be configured to support a golf ball prior to the retracting mechanism 1506 retracting the support member 1504. In one embodiment, the support member 1504 may be divided into two parts, a top part 1504*a* and a bottom part 1504*b*. In various embodiments, the retracting golf tee may be installed at least partially underground as is depicted with the broken ground line 1514.

In various embodiments, the retracting golf tee includes a retracting mechanism 1506 configured to retract at least a portion of the support member 1504 prior to impact between the support member 1504 and an approaching golf club face. In one embodiment, the retracting mechanism 1506 comprises a solenoid configured to provide a magnetic force to retract the support member 1504. In another embodiment, the retracting mechanism 1506 comprises a spring, or the like, configured to provide a tension force to retract the support member 1504. In other embodiments, the retracting mechanism 1506 may include an explosive configured to provide an explosive force to retract the support member 1504. In one embodiment, the retracting mechanism 1506 may comprise a motor configured to retract the support member 1504. In some embodiments, the retracting mechanism 1516 may include a braking mechanism configured to brake the retraction such that post-retraction impact forces (e.g., between support members 1504*a* and 1504*b*) are reduced.

In the various embodiments described above, the retracting mechanism 1506 may be configured to retract the support member 1504, or at least the top part of the support member 1504*a*, faster than a supported golf ball would fall. Retracting the support member 1504 faster than the golf ball will fall provides that the golf ball is not in contact with the contact surface of the golf tee upon impact between the golf ball and the approaching golf club face. In one embodiment, the retracting mechanism 1506 may be configured to retract the support member 1504 at greater than 100 g. It will be appreciated that with such high acceleration retractions, that in some embodiments the golf tee may be designed for horizontal or inclined axis retraction of the support members rather than vertical retraction.

In the various embodiments, the retracting golf tee may include a processing unit 1516, configured to control the retracting mechanism based on motion parameters of an approaching golf club face and/or other measurements from the various sensors coupled with the processing unit 1516. In one embodiment, the processing unit 1516 may be configured to control the retracting mechanism 1506 to retract the support member 1504 such that the golf ball drops less than a defined distance prior to impact between the golf ball and the approaching golf club face. In order to achieve this, the processing unit 1516 may determine a retraction start time and speed based on the defined distance and motion parameters of the approaching golf club face. For example, the defined distance may be 0.5 mm, in which case the time interval between the retraction start and impact between the golf club face and the golf ball should be approximately 10 milliseconds or less. In this example, if the golf club face has a speed of 100 miles per hour, then the retraction should be started when the golf club face is 1.5 feet from the golf ball. By retracting the contact surface at 100 g, the contact surface of the golf tee will be 2 inches below the golf ball at the time of impact between the golf ball and the golf club face, and hence not likely to be impacted by the golf club. In another embodiment, the processing unit 1516 may be configured to determine a retraction time and speed based on a defined separation between the contact surface and the golf ball at impact between the golf ball and the approaching golf club face.

In one embodiment, the motion parameters used by the processing unit 1516 to determine a retraction time and speed may be provided by at least one swing sensor such as swing sensor 1508. The swing sensor 1508 may be implemented as described above with regard to FIGS. 2 and 3. The processing unit may use the motion parameters to determine, for example, an estimated impact time between the approaching golf club face and the golf ball and a position of the approaching golf club face relative to the golf ball (e.g., a distance between the approaching golf club face and the golf ball).

In another embodiment, the retracting golf tee may include an impact sensor 1510 configured to detect a shock wave, or other impact indicator, caused by impact between the golf club face and the golf ball. In response to detecting the impact, the processing unit 1516 may be configured to control the retracting mechanism 1506 to retract the support member 1504 at high acceleration (e.g., explosively) to reduce and/or eliminate the friction between the golf ball and the contact surface 1502.

In some embodiments, the retracting golf tee may include a golf ball sensor 1512 configured to monitor motion parameters of the golf ball (e.g., position, speed, spin, etc.) prior to impact between the golf ball and the golf club face. The golf ball sensor 1512, may be configured to monitor, for example, a position of the golf ball and record a drop distance of the golf ball in a memory of the processing unit. In one embodiment, the golf ball sensor 1512 and/or the processing unit 1516 may be configure to record the drop distance of the golf ball when the distance exceeds a threshold. In another embodiment, the golf ball sensor 1512 may be configured to monitor, for example, a position of the golf ball and record a lateral displacement of the golf ball imparted by retracting the support member in a memory of the processing unit. In other embodiments, the golf ball sensor 10512 may be configured to monitor a spin of the golf ball imparted by retracting the support member and record the spin in a memory of the processing unit 1516. The parameters of the golf ball monitored by the golf ball sensor 1512 may be used by the processing unit 1516 to adjust future retractions. Similarly, the parameters may be used for later post impact analysis to determine the affect of the parameters on the post impact trajectory of the golf ball.

In various embodiments, the retracting golf tee may include a spin mechanism as described above to impart spin to the golf ball prior to retracting the golf tee such that a particular post-impact trajectory of the golf ball may be achieved.

Figure 16:
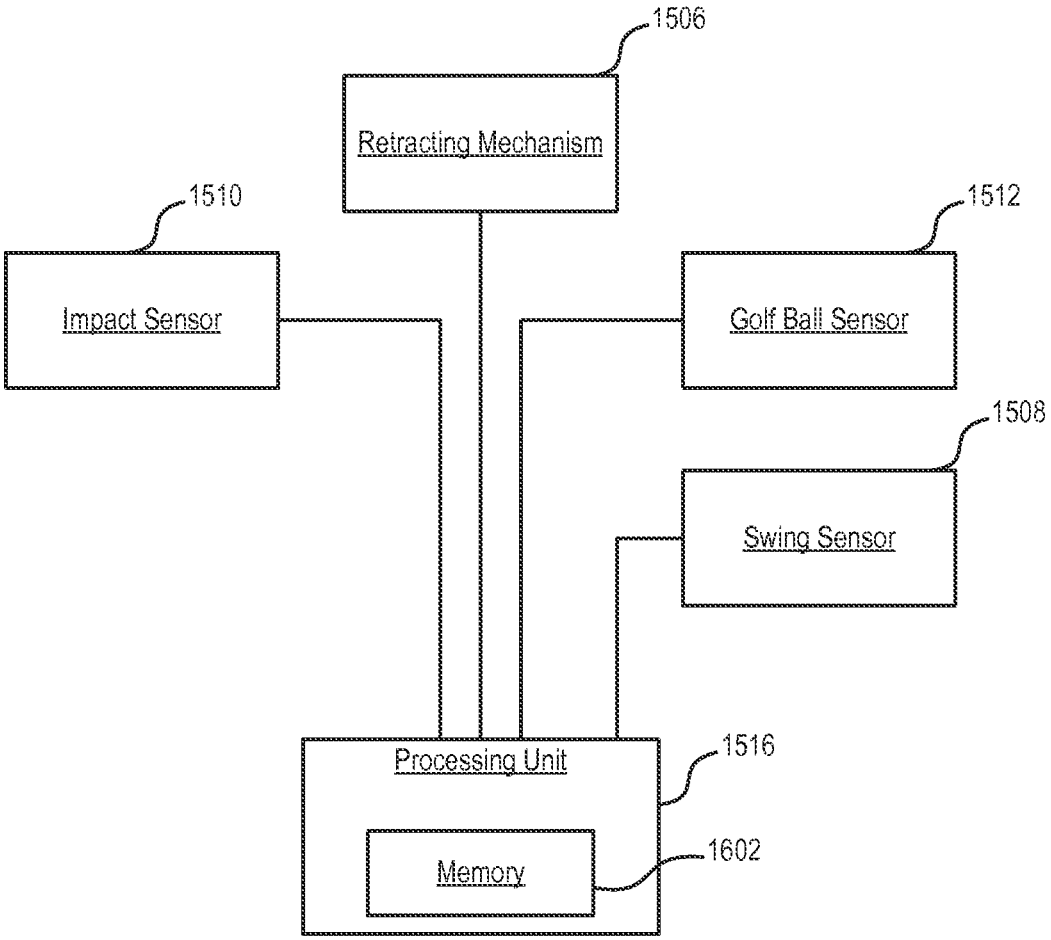
FIG. 16 illustrates a block diagram of a retracting golf tee.

FIG. 16 illustrates a block diagram of a retracting golf tee. The block diagram of FIG. 16 depicts the various sensors and mechanisms described above with regard to FIG. 15 coupled with the processing unit 1516. The processing unit 1516 may include a memory 1602 and may be coupled with retracting mechanism 1506, swing sensor 1508, impact sensor 1510, and golf ball sensor 1512. The connection between the sensors and mechanisms depicted in FIG. 16 may be wire connections and/or wireless connections.

Figure 17:
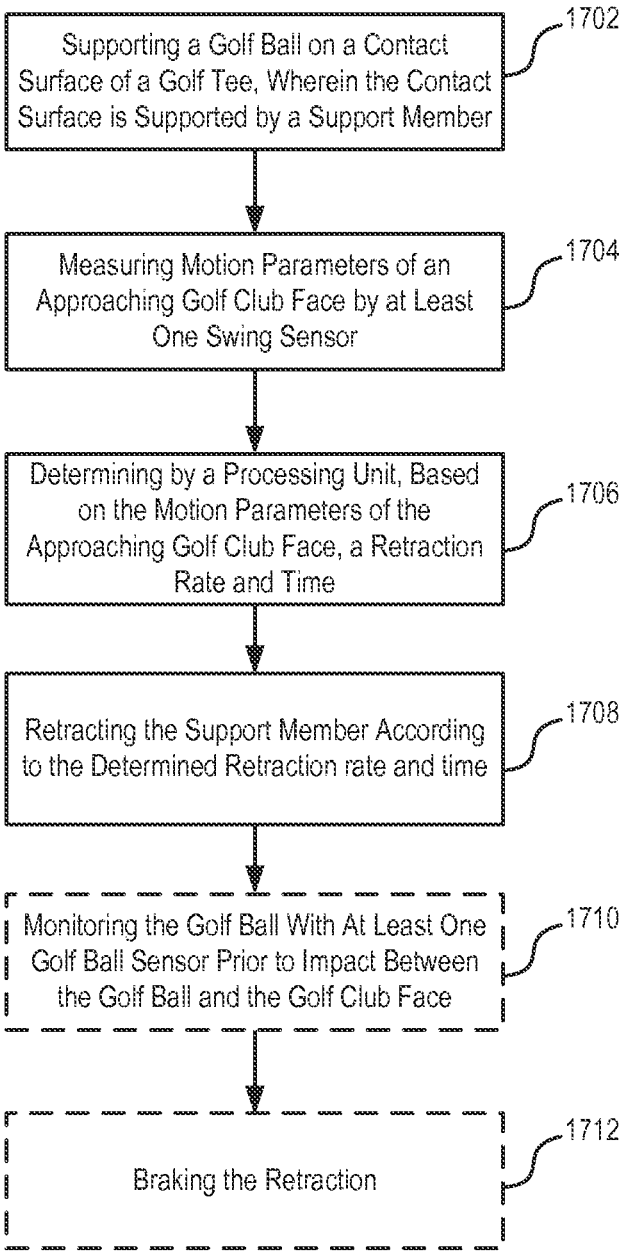
FIG. 17 illustrates an example flow diagram of an example method for using a retracting golf tee.

FIG. 17 illustrates an example flow diagram of an example method for using a retracting golf tee. The method begins at 1702 with supporting a golf ball on a contact surface of a golf tee. The contact surface of the golf tee may be supported by a support member such as support member 1504. The method continues at 1704 with measuring motion parameters of an approaching golf club face by at least one swing sensor, such as swing sensor 1508.

The method continues at 1706 with determining by a processing unit, such as processing unit 1516, a retraction rate and time based on the motion parameters of the approaching golf face. In various embodiments, the processing unit may determine the retraction rate and time such that the golf ball is not in contact with the contact surface upon impact between the golf ball and the approaching golf club face. For example, the processing unit may determine the retraction rate and time such that the golf ball drops less than a defined distance prior to impact between the golf ball and the approaching golf club face. Similarly, the retraction rate and time may be determined such that the retracting mechanism retracts the support member faster than the golf ball will fall. For example, the retraction rate may be determined to be greater than 100 g.

In some embodiments, the retraction time is prior to impact between the approaching golf club face and the golf ball. For example, the processing unit may determine an acceptable drop distance for the golf ball prior to impact with the golf club face and determine a retraction time based on the acceptable drop distance, the speed of the approaching golf club face, and the distance between the golf ball and the approaching golf club face. Similarly, the processing unit may use a predicted impact time for the approaching golf club face, based on motion parameters of the approaching golf club face, to determine the retraction rate and time. In other embodiments, the retraction is initiated upon impact between the golf ball and the approaching golf club face. For example, an impact sensor, such as impact sensor 1510, may detect a shock wave caused by impact between the golf ball and the golf club face, which may be used by the processing unit to initiate the retraction of the support member.

After determining a retraction rate and time, the method continues at 1708 with retracting the support member by a retracting mechanism, such as retracting mechanism 1506, according to the determined retraction rate and time. In various embodiments, retracting the support member may be performed, for example, by a solenoid, a spring, an explosion, a motor, or the like.

Optionally, the method may continue at 1710 with monitoring the golf ball by a golf ball sensor, such as golf ball sensor 1512, prior to impact between the golf ball and the golf club face. Monitoring the golf ball may include, for example, tracking a position of the golf ball, determining a spin imparted to the golf ball by retracting the support member, or the like. In some embodiments, data characterizing the monitored aspects of the golf ball may be stored in a memory of the processing unit. The method may continue with braking the retraction at 1712 such that post-impact retraction forces within the golf tee are reduced.

Figure 18:
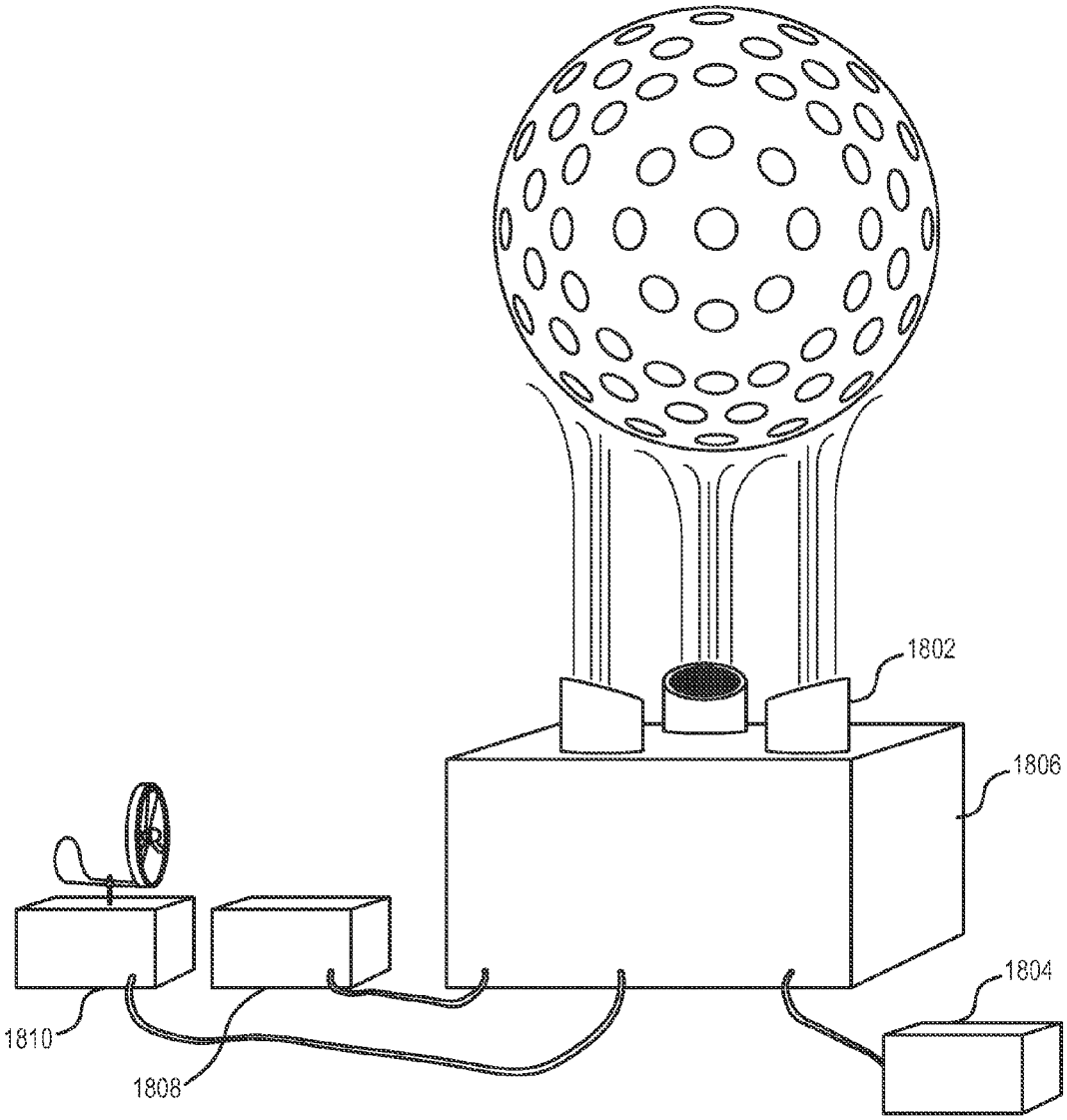
FIG. 18 illustrates an example embodiment of a contactless golf tee.

To further reduce spin imparted to the golf ball by friction between a contact surface of a golf tee and the golf ball at impact between the golf ball and a golf club face, a contactless golf tee may be employed. FIG. 18 illustrates an example embodiment of a contactless golf tee. In various embodiments, the contactless golf tee may include a support mechanism 1802, a position sensor 1804, a processing unit 1806, a swing sensor 1808, and an environmental conditions sensor 1810.

In the example of FIG. 18, the contactless golf tee includes a support mechanism 1802 configured to support a golf ball such that the golf ball is not in contact with a solid surface. In one embodiment, the support mechanism 1802 may provide one or more gas or air streams to support the golf ball. The air streams may be provided by a blower, compressed air, or the like. In another embodiment, the support mechanism 1802 may provide a magnetic field to support the golf ball. In this example embodiment, the support mechanism may include an electromagnet configured to support a golf ball containing a magnet, for example.

In some embodiments, the contactless golf tee may include a position sensor 1804 configured to detect and monitor the golf ball prior to impact between the golf ball and an approaching golf club face. The position sensor 1804 may be configured to monitor a position, spin, lateral motion, or the like, of the golf ball while being supported by the support mechanism 1802. In various embodiments, the position sensor, may be for example, a radar unit, a lidar unit, a camera, an ultrasound unit, an infrared unit, or the like.

In some embodiments, the position of the golf ball held by the support mechanism 1802 may be adjustable. To control the position of the golf ball, a processing unit 1806 may be in communication with the support mechanism 1082 and configured to control the support mechanism, based on data from the position sensor 1804, to manipulate the position of the golf ball. For example, the processing unit 1806 may adjust the air flowing from one or more of the air streams to adjust the vertical or lateral position of the golf ball. Similarly, in the example of the electromagnetic support mechanism, the processing unit may control the current flowing through an actively varied electromagnet to manipulate the position of the golf ball.

In some embodiments, the contactless golf tee may include one or more swing sensors 1808 configured to measure motion parameters of an approaching golf club face. The swing sensor may be similar to those described above. In various embodiments, the processing unit 1806 may be configured to control the support mechanism 1802 to move the golf ball, prior to impact between the golf ball and an approaching golf club face, based on the motion parameters from the swing sensor 1808. For example, the processing unit 1806 may control the support mechanism 1802 to hold the golf ball stable, change a vertical position of the golf ball, change a horizontal position of the golf ball, impart spin to the golf ball, or the like. For example, spin and/or position changes may be used to compensate for detected swing errors based on the motion parameters of the approaching golf club face. The control may facilitate in optimal contact between the golf ball and golf club face to achieve a particular post-impact trajectory.

Additionally, in some embodiments, the contactless golf tee may include an environmental conditions sensor 1810 to provide environmental conditions for the processing unit 1806 to use in determining how to control the support mechanism 1802. The environmental conditions sensor may be similar to those described above.

Figure 19:
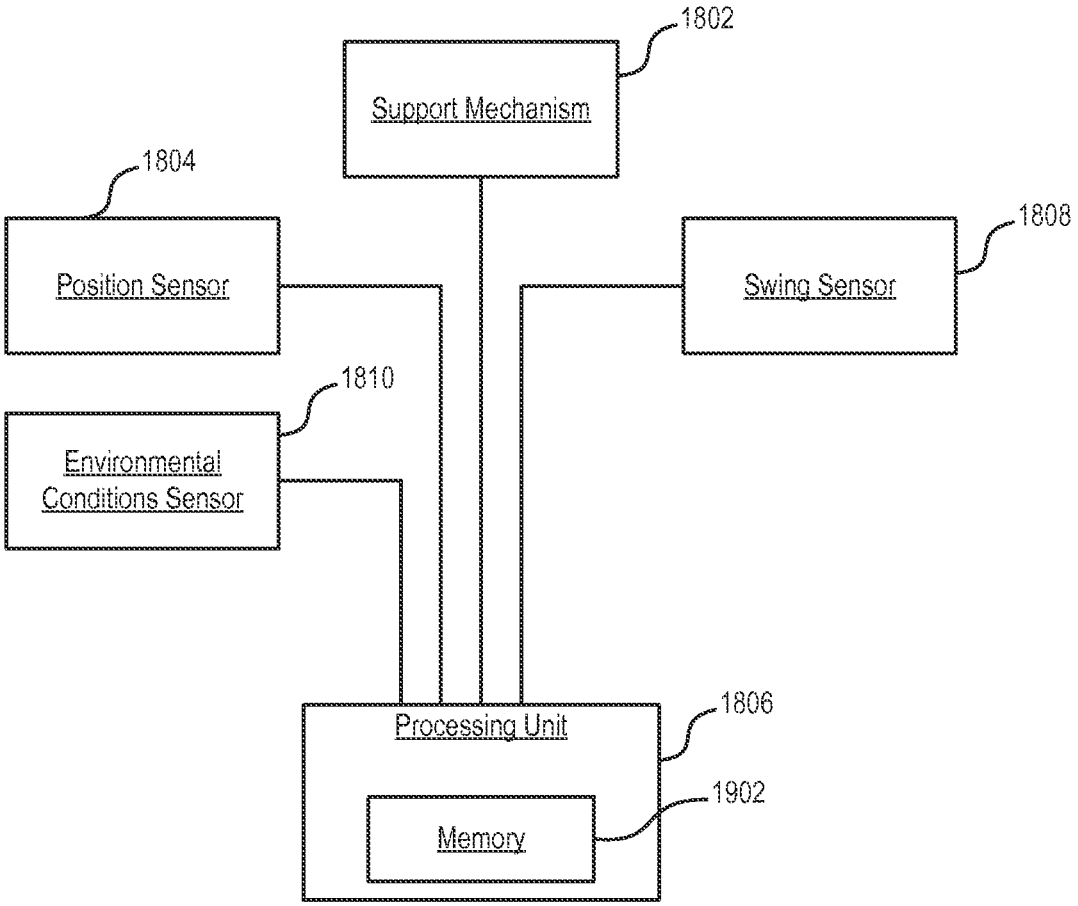
FIG. 19 illustrates a block diagram of a contactless golf tee.

FIG. 19 illustrates a block diagram of a contactless golf tee. As described above, the contactless golf tee may include a processing unit 1806, including a memory 1902, coupled with the support mechanism 1802, position sensor 1804, swing sensor 1808, and environmental conditions sensor 1810. In various embodiments, the memory 1902 may be configured to record motion parameters of the approaching golf club, position and spin of the golf ball, and other information for addition to a golfer's profile. The connection between the sensors and mechanisms depicted in FIG. 16 may be wire connections and/or wireless connections.

Figure 20:
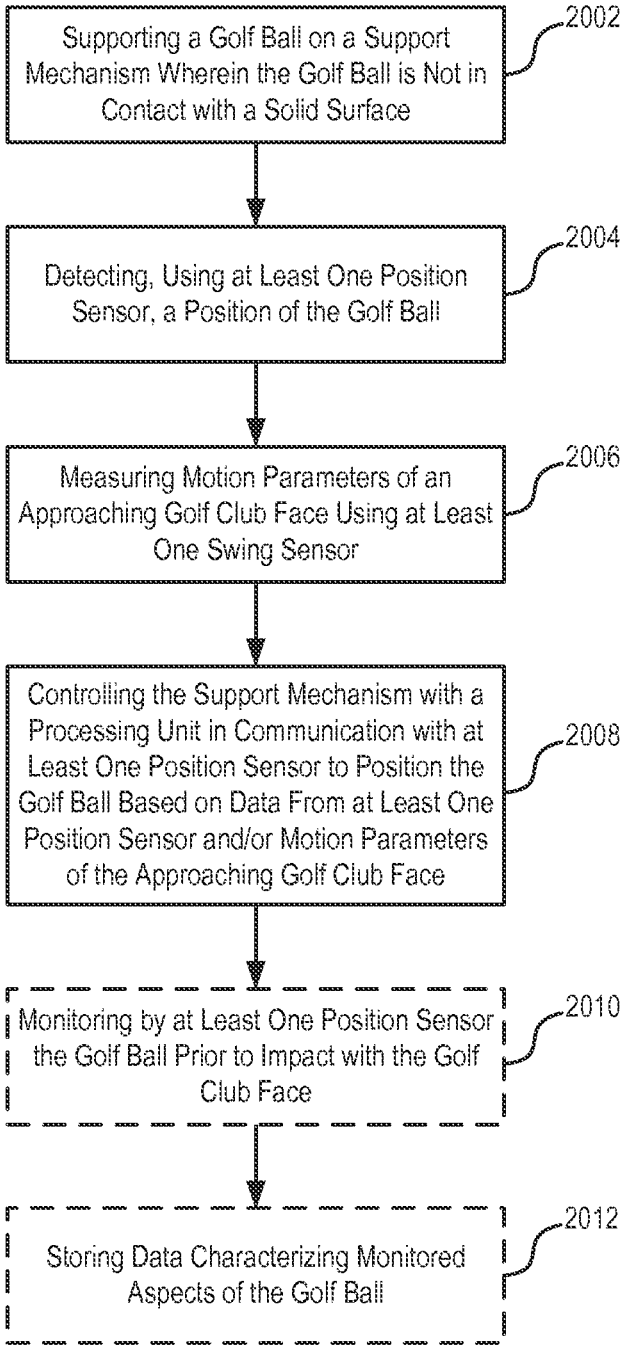
FIG. 20 illustrates an example flow diagram of an example method for using a contactless golf tee.

FIG. 20 illustrates an example flow diagram of an example method for using a contactless golf tee. The method begins at 2002 with supporting a golf ball by a support mechanism wherein the golf ball is not in contact with a solid surface. As described above, the support mechanism may be provided by one or more air streams, magnets, or the like. The method continues at 2004 with detecting, using at least one position sensor, a position of the golf ball. The method may include, at 2006, measuring motion parameters of an approaching golf club face using at least one swing sensor, such as swing sensor 1808.

Based on the position of the golf ball and/or the motion parameters of an approaching golf club face, at 2008 the method continues with controlling the support mechanism, by a processing unit in communication with the position sensor and/or swing sensor, to position the golf ball based on data from the position sensor and/or swing sensor. For example, the processing unit 1806 may control the support mechanism 1802 to hold the golf ball stable, change a vertical position of the golf ball, change a horizontal position of the golf ball, impart spin to the golf ball, or the like. The control may facilitate in optimal contact between the golf ball and golf club face to achieve a particular post-impact trajectory. In some embodiments, the processing unit 1806 may shut off the support mechanism 1802 prior to, or at, impact between the golf ball and an approaching golf club face.

In some embodiments, at 2010, the method may include monitoring, by the position sensor, the golf ball prior to impact between the golf ball and the golf club face. Monitoring the golf ball may include, for example, monitoring the position, spin, movement, etc. of the golf ball. At 2012, the method may include storing data characterizing the monitored aspects of the golf ball. In some embodiments, the data may include an indication of whether any of the monitored aspects of the golf ball have exceeded a threshold value.

Even conventional golf tees are not all that passive. As described above, as a golf ball is impacted by a golf club face, the golf ball deforms, pushing against the surface of the golf tee and imparting spin to the golf ball due to the friction. According to the techniques introduced here, this friction may be harnessed to impart spin to the golf ball to achieve a particular post impact trajectory.

Figure 21:
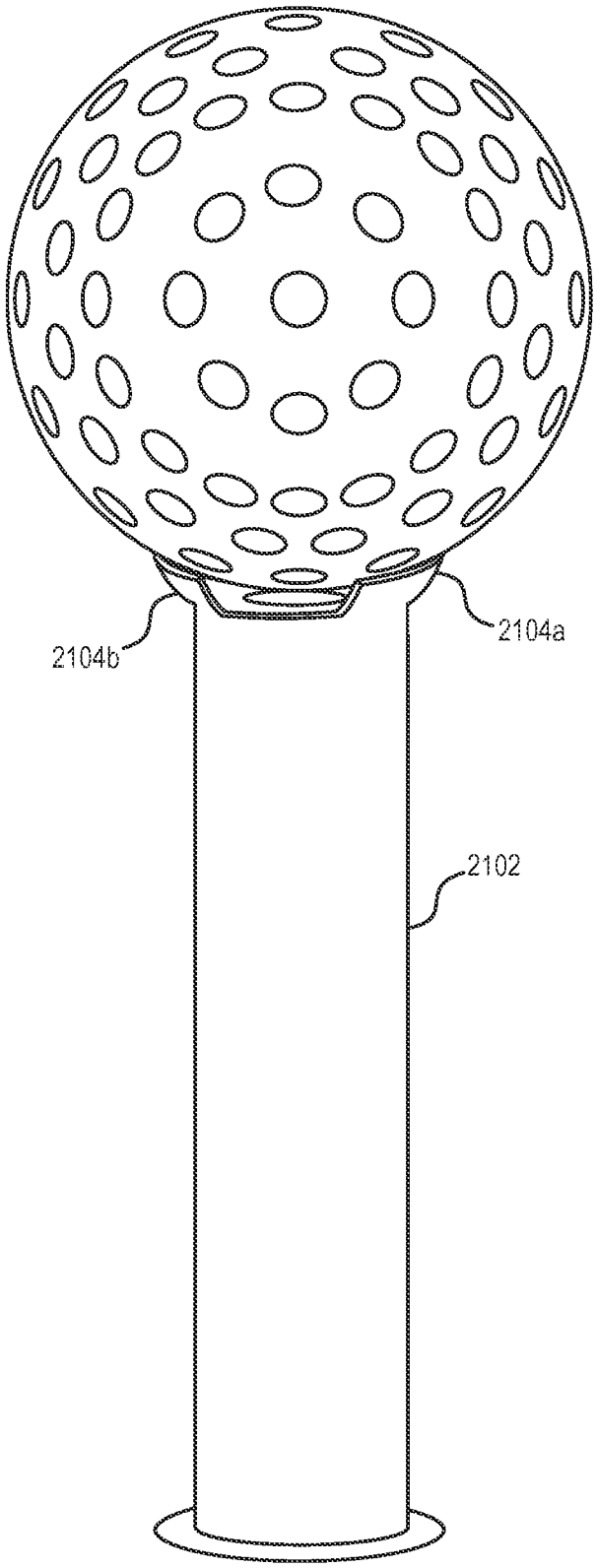
FIG. 21 illustrates an example embodiment of a golf tee having asymmetrically distributed support members.

In one embodiment, asymmetrically distributed support members on a golf tee may be used to impart a particular spin to a golf ball upon impact between the golf ball and an approaching golf club face. FIG. 21 illustrates an example embodiment of a golf tee having asymmetrically distributed support members. The golf tee may include a shaft 2102 and a plurality of support members 2104 coupled with the upper end of the shaft. In various embodiments, the lower end of the shaft 2102 may be configured to be inserted into or supported by an underlying surface, such as a teeing ground.

In various embodiments, the plurality of support members 2104 may be asymmetrically distributed such that a first contact area between the plurality of support members on one half of the golf ball, 2014*a*, is greater than a second contact area between the plurality of support members on the other half of the golf ball, 2014*b*. For example, in one embodiment, the first contact area may be greater than one square millimeter, but less than three square millimeters and the second contact area may be greater than three square millimeters.

Figure 22:
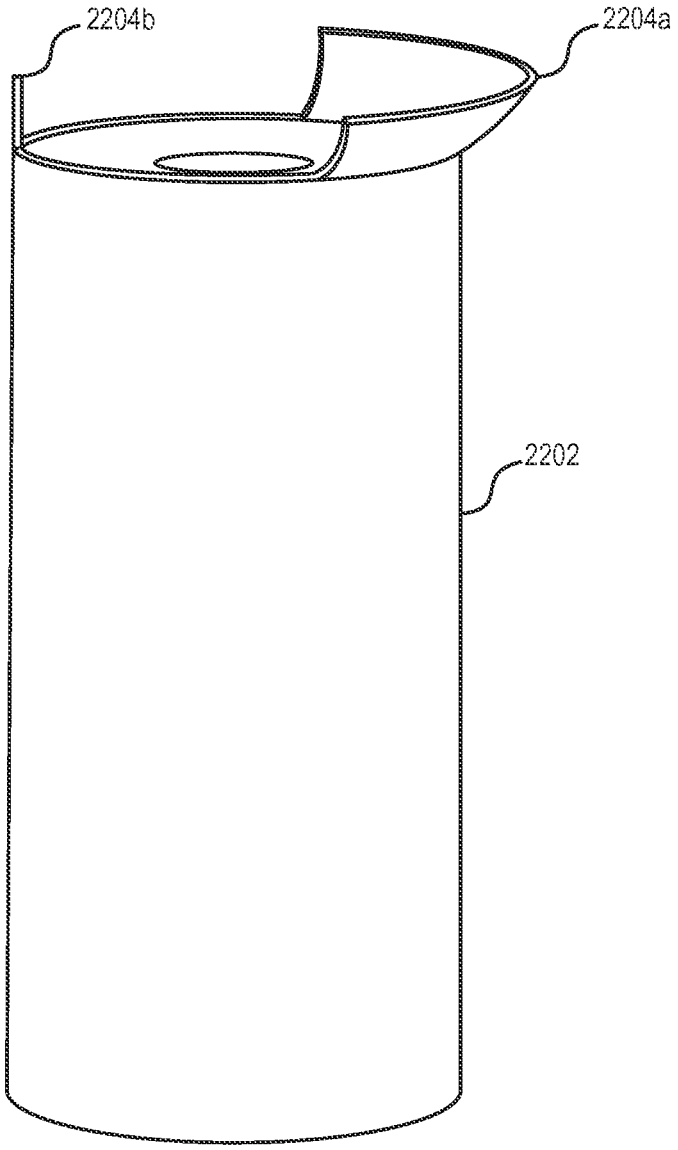
FIG. 22 illustrates an example embodiment of a golf tee having asymmetrically distributed support members.

FIG. 22 illustrates an example embodiment of a golf tee having asymmetrically distributed support members. In various embodiments, the golf tee may include two support members 2204*a* and 2204*b* as shown in the example of FIG. 22. The two support members, 2204*a* and 2204*b*, may each contact the golf ball across a continuous circular arc, with the arc of support member 2204*a* being larger than the arc of support member 2204*b*. In one embodiment, the circular arc of support member 2204*a* may be between 30 degrees and 180 degrees, while the circular arc of support member 2204*b* may be less than 5 degrees.

Figure 23:
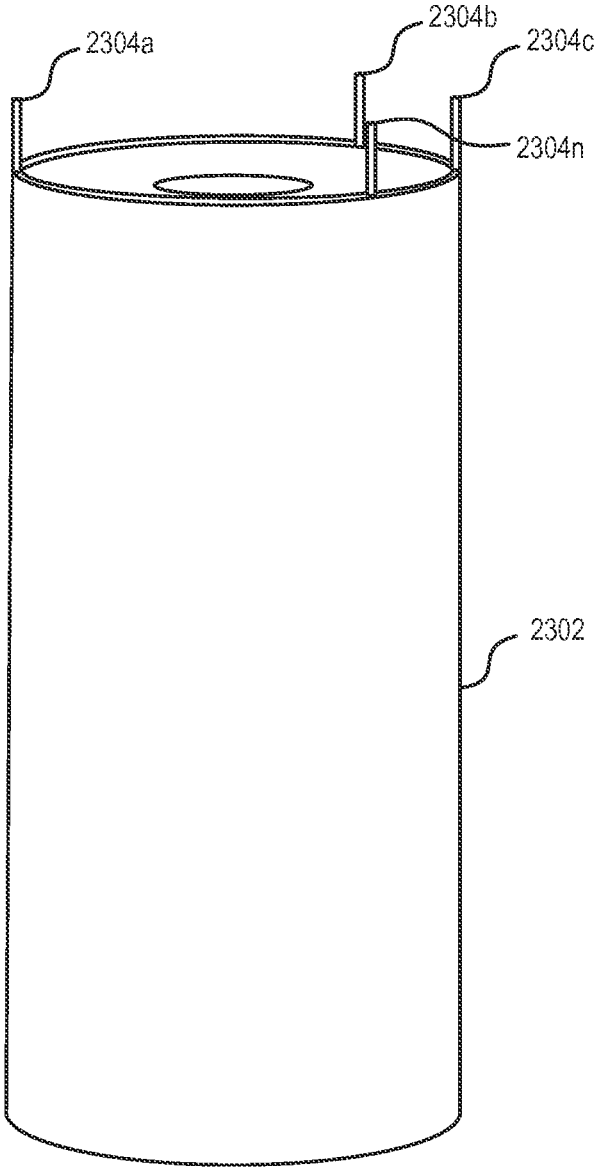
FIG. 23 illustrates an example embodiment of a golf tee having asymmetrically distributed support members.

FIG. 23 illustrates an example embodiment of a golf tee having asymmetrically distributed support members. In some embodiments, the golf tee may include three or more support members, 2304*a*-2304*n*, as shown in the example of FIG. 23. In one embodiment, each of the support members have an equal contact area with the golf ball. However, the cumulative contact area on one hemisphere of the golf ball is greater than the cumulative contact area on the other hemisphere of the golf ball. For example, as shown in FIG. 23, the cumulative contact area of support members 2304*b*, 2304*c*, and 2304*n* is greater than the contact area of support member 2304*a*. In other embodiments, the support members may each have different contact areas on the golf ball, with the cumulative contact areas of the support members on each hemisphere of the golf ball being different.

The greater contact area on one side of the golf ball results in more friction between the support members and the golf ball on that side. The imbalance of friction between the two sides may impart a left hand or right hand spin, topspin, or backspin on the golf ball depending on the orientation of the golf tee. The golfer may select which direction of spin to impart to the golf ball based on the way the golfer orients the support members when the shaft of the golf tee is inserted into or supported by the ground. The selected spin may be used by a golfer to counteract an anticipated swing error and help the golfer achieve a particular post-impact trajectory. The selected spin may be used by a golfer to achieve a particular post-impact trajectory (e.g., a slice, hook, loft, ground roll) based on the course layout. The amount of spin can be varied by varying the difference in the contact areas.

Figure 24:
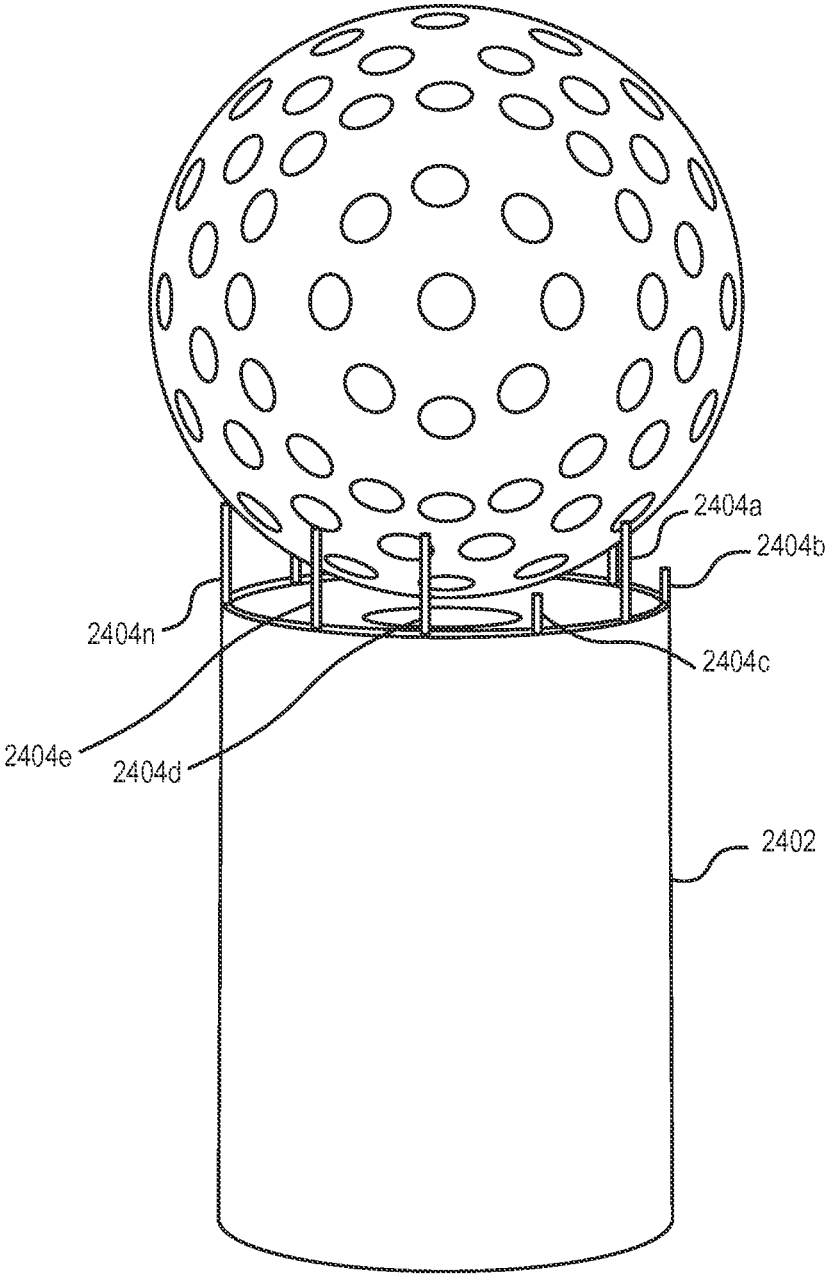
FIG. 24 illustrates an example embodiment of a golf tee having dynamic asymmetrically distributed support members.

In some embodiments, the amount of spin imparted to the golf ball by the plurality of support members may be dynamically adjusted by a golf tee with dynamic support members. FIG. 24 illustrates an example embodiment of a golf tee having dynamic asymmetrically distributed support members. The golf tee in the example of FIG. 24 includes a shaft 2402 and a plurality of dynamic support members 2404. The plurality of dynamic support members 2404 may be configurable to vary the cumulative contact areas between the two hemispheres of the golf ball. Although the figure depicts the plurality of support members as point supports, it should be understood that support members having a larger circular arc may also be used.

In various embodiments, the cumulative contact area between each of the hemispheres of the golf ball may be adjusted independently of one another. For example, one or more of the plurality of support members 2404 may be configured to be refracted, such as the support members 2404*b* and 2404*c* in the example of FIG. 24, to reduce the cumulative contact area between the golf ball and the plurality of support members. In one embodiment, the plurality of support members 2404 are manually retractable and extendable by the golfer. In other embodiments, the golf tee may include one or more motors, solenoids, microelectromechanical systems (MEMS), piezoelectric actuators, or the like, configured to automatically retract and extend the plurality of support members 2404.

Figure 25:
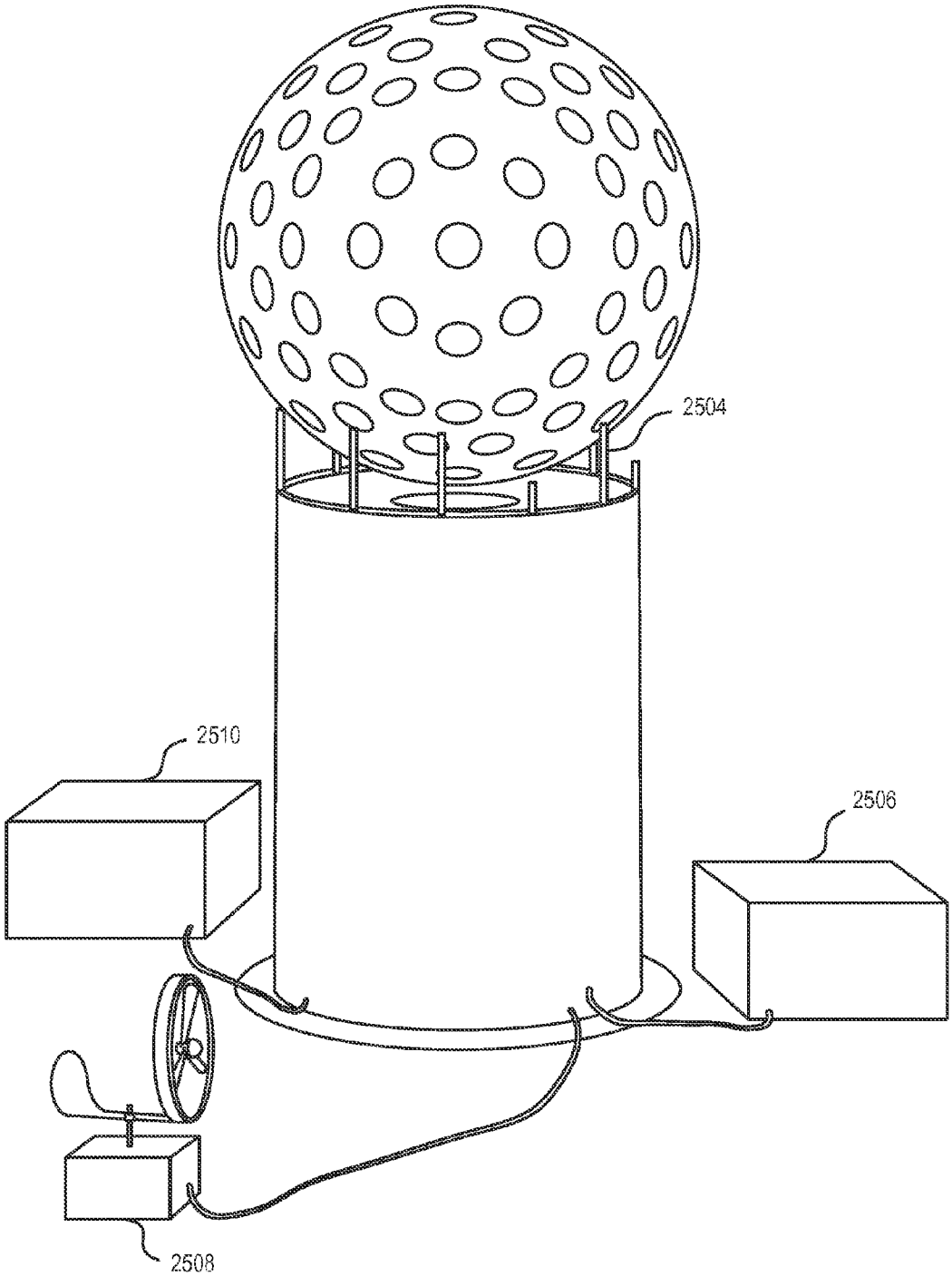
FIG. 25 illustrates an example embodiment of a golf tee having dynamic asymmetrically distributed support members controlled based on information from various sensors.

FIG. 25 illustrates an example embodiment of a golf tee having dynamic asymmetrically distributed support members controlled based on information from various sensors. Similar to the embodiments described above, in some embodiments the golf tee in the example of FIG. 25 may include a processing unit configured to control the automatic retraction of at least a subset of the plurality of dynamically retractable support members 2504. Additionally, the processing unit may receive information from various sensors, such as motion parameters from swing sensor 2506 and environmental conditions from environmental conditions sensor 2508, in determining which, and how many, of the plurality of support members 2504 to retract. The swing sensor 2506 and environmental conditions sensor 2508 may be similar to those described above with reference to other golf tee embodiments.

In other embodiments, the processing unit may include a memory configured to store historical swing characteristics of a golfer, golf course layout, hole location information, etc. for use by the processing unit in determining which, and how many, of the plurality of support members 2504 to retract. Additionally, the golf tee may include a location sensor 2510, such as a global positioning unit, configured to determine a location of the golf tee for use by the processing unit with, for example, hole location or golf course layout information to determine which, and how many, of the plurality of support members 2504 to retract.

Figure 26:
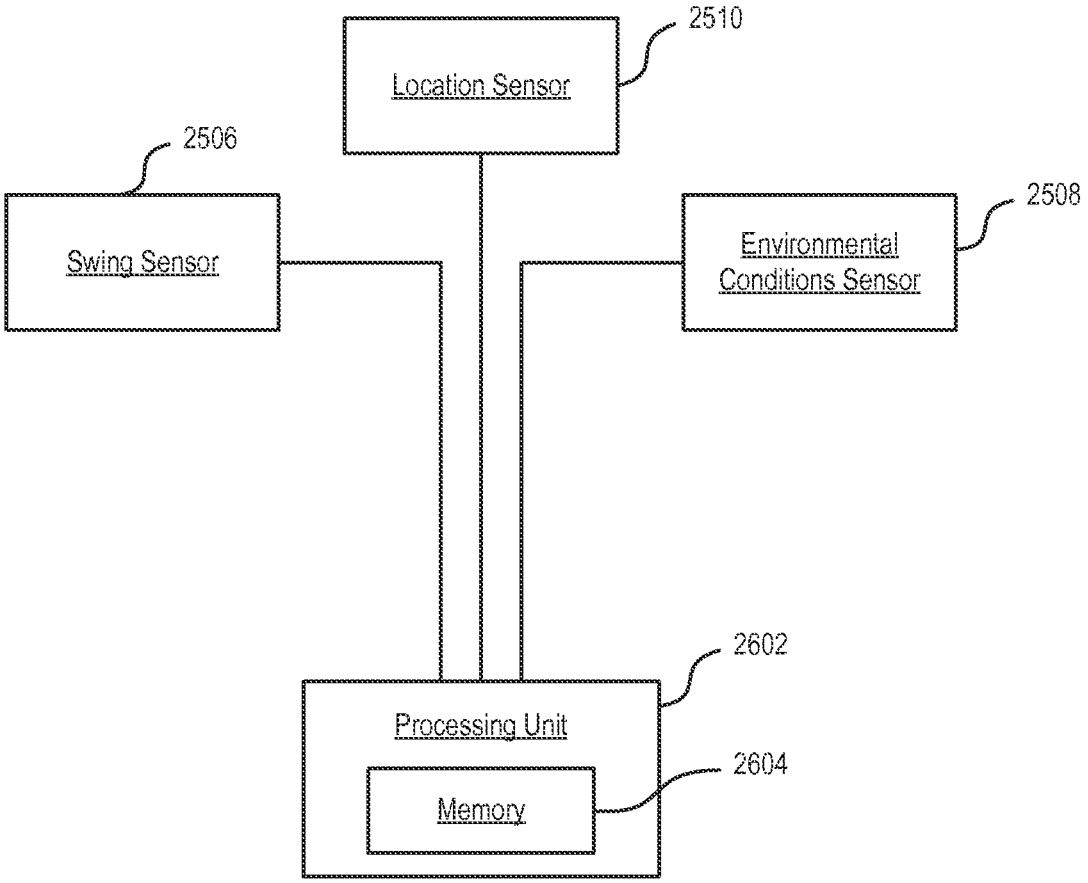
FIG. 26 illustrates a block diagram of a golf tee having dynamic asymmetrically distributed support members.

FIG. 26 illustrates a block diagram of a golf tee having dynamic asymmetrically distributed support members. As described above, a golf tee having a plurality of dynamically adjustable support members may include a processing unit 2602, including a memory 2604, coupled with the swing sensor 2506, environmental conditions sensor 2508, and location sensor 2510. The connection between the sensors and mechanisms depicted in FIG. 26 may be wire connections and/or wireless connections.

Figure 27:
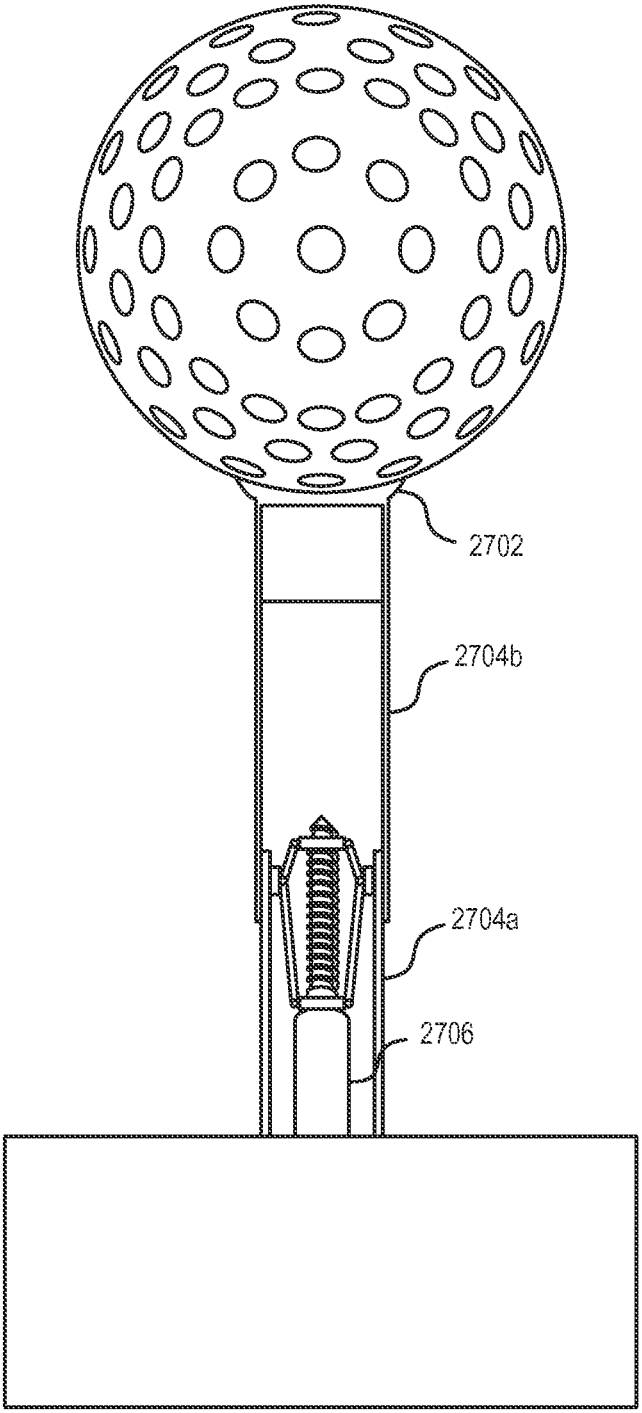
FIG. 27 illustrates an example embodiment of a two part golf tee.

In some embodiments, the spin (e.g., topspin or backspin) imparted to a golf ball due to the friction between the golf ball and a contact surface of the golf tee may be adjusted by adjusting the resistance with which the contact surface resists downward force applied by the deformed golf ball on impact. In various embodiment, a two part golf tee with an adjustable resistance mechanism may be used to adjust this resistance. FIG. 27 illustrates an example embodiment of a two part golf tee. The two part golf tee may include a contact surface or support member 2702 configured to support a golf ball, a two part shaft 2704, and an adjustable resistance mechanism 2706.

The two part shaft may include a first part 2704*a* and a second part 2704*b*. The first part 2704*a* may be configured to be inserted into, or supported, by the ground under the golf tee and configured to slideably receive the second part 2704*b*. As depicted in the example of FIG. 27, the second part 2704*b* slides on the outside of the first part 2704*a*. However, in other embodiments, the second part 2704*b* may be configured to slide on the inside of the first part 2704*a*. In some embodiments, the second part 2704*b* may be configured to rotate (e.g., via threads in the interface between the first part 2704*a* and the second part 2704*b*, via longitudinally twisting cross-sections for the first part 2704*a* and the second part 2704*b*, etc.) as the second part slides downward with respect to the first part, thereby imparting sidespin to the golf ball. The golfer may accept a present amount of resistance (and hence sidespin) or, through the use of an adjustable resistance mechanism 2706, the amount of sidespin can be controllably varied.

The resistance mechanism 2706 is configured to adjust the resistive force with which the support member resists downward pressure from the golf ball. In some embodiments, the resistance mechanism may be manually adjusted to increase or decrease the resistive force. In other embodiments, the resistance mechanism may be automatically adjustable, under control of a processing unit, to increase or decrease the resistive force based on information provided to the processing unit. For example, the processing unit may be coupled with a swing sensor and/or an environmental conditions sensor, as described above, and may adjust the resistance based on information received from the sensors.

Figure 28:
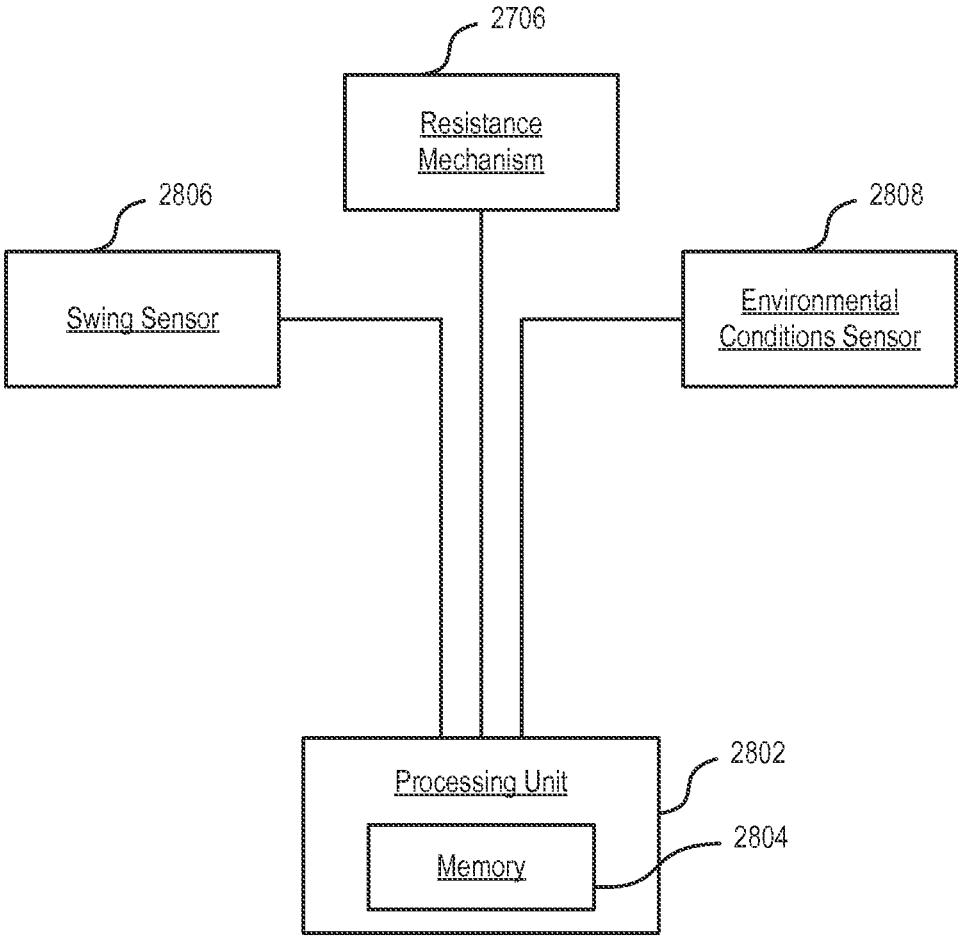
FIG. 28 illustrates a block diagram of a two part golf tee.

FIG. 28 illustrates a block diagram of a two part golf tee. The two part golf tee may include a processing unit 2802, including a memory 2804, coupled with the resistance mechanism 2706, swing sensor 2806 configured to measure motion parameters of an approaching golf club face, and environmental conditions sensor 2808 configured to measure current environmental conditions. In various embodiments, the memory 2804 may be configured to record motion parameters of the approaching golf club and other information for addition to a golfer's profile. In some embodiments, the historical swing characteristics in the golfer's profile may be used, in addition to or in place of information from the various sensors, by the processing unit to adjust the resistance mechanism. The connection between the sensors and mechanisms depicted in FIG. 28 may be wire connections and/or wireless connections.

Figure 29:
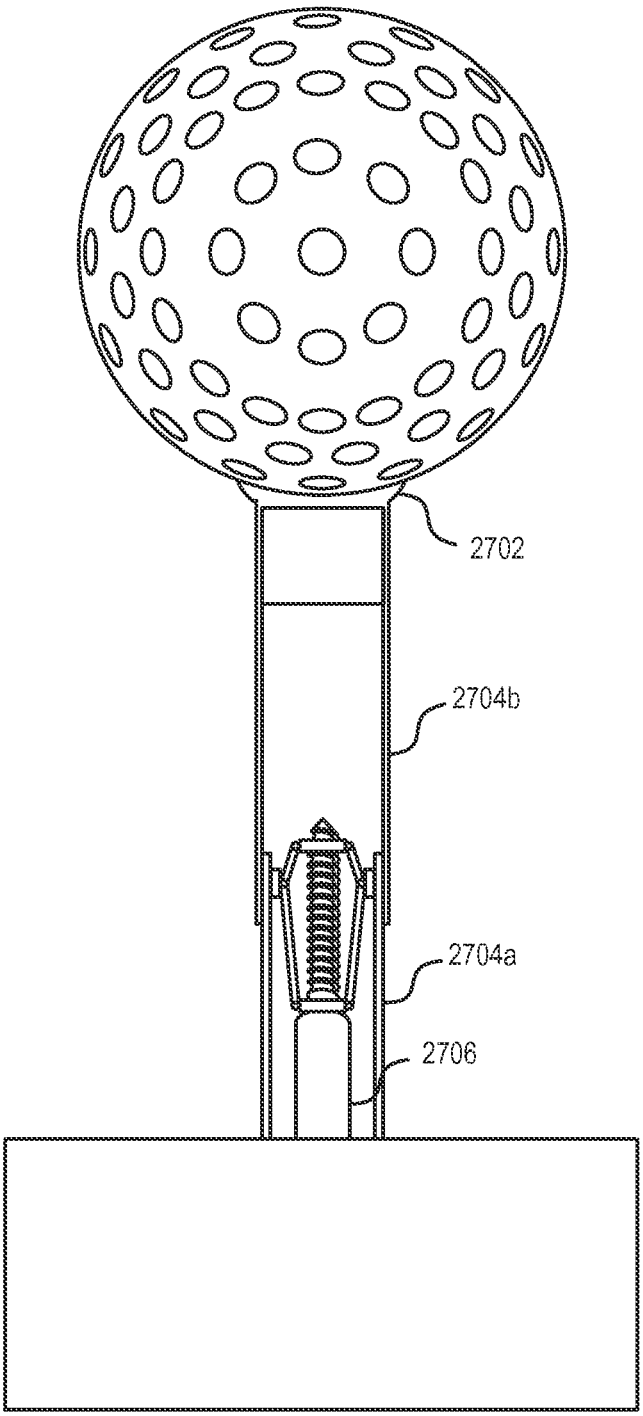
FIG. 29 illustrates an example embodiment of a resistance mechanism of a two part golf tee.

In some embodiments, the resistive force between the two parts of the two part golf tee comprises friction between the first part 2704*a* and the second part 2704*b*. FIG. 29 illustrates an example embodiment of a resistance mechanism of a two part golf tee. The resistance mechanism 2706 in the example of FIG. 29 is configured to adjust lateral pressure between the first part 2704*a* and the second part 2704*b*, which increases or decreases the friction between the first part 2704*a* and the second part 2704*b*. The resistance mechanism may include, for example, a solenoid, a piezoelectric actuator, or a mechanical arrangement. As the friction is increased or decreased, the resistive force with which the support member 2702 resists downward pressure from the golf ball increases or decreases, respectively. The increase or decrease in the resistive force adjusts the spin imparted to the golf ball by friction between the support member and the golf ball.

Figure 30:
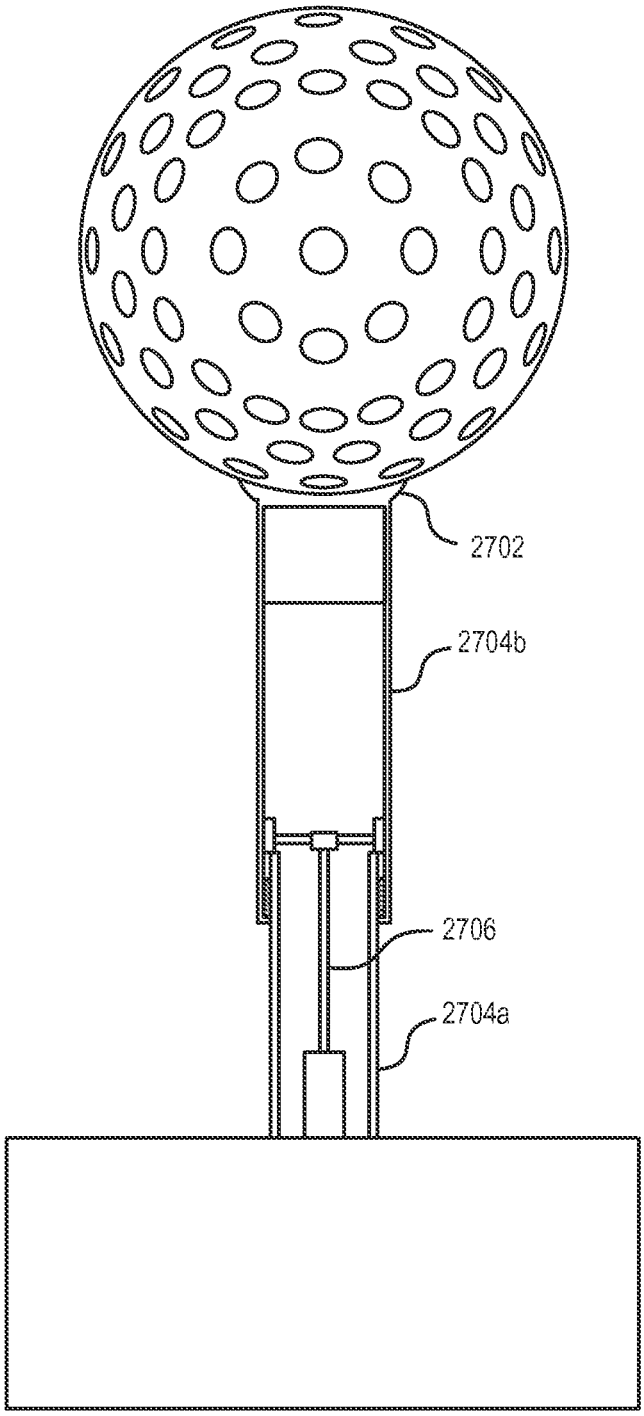
FIG. 30 illustrates an example embodiment of a resistance mechanism of a two part golf tee.

In another embodiment, the resistance mechanism may include a lubrication system configured to adjust the amount of lubrication between the two parts of the two part golf tee. FIG. 30 illustrates an example embodiment of a resistance mechanism of a two part golf tee. The resistance mechanism 2706 in the example of FIG. 30 is configured to adjust the amount of lubrication between the first part 2704*a* and the second part 2704*b* of the two part golf tee, which increases or decreases the friction between the first part 2704*a* and the second part 2704*b*. The resistance mechanism may include, for example, a lubrication pump to increase or decrease the amount of lubrication. As the friction is increased or decreased, the resistive force with which the support member 2702 resists downward pressure from the golf ball increases or decreases, respectively. The increase or decrease in the resistive force adjusts the spin imparted to the golf ball by friction between the support member and the golf ball.

Figure 31:
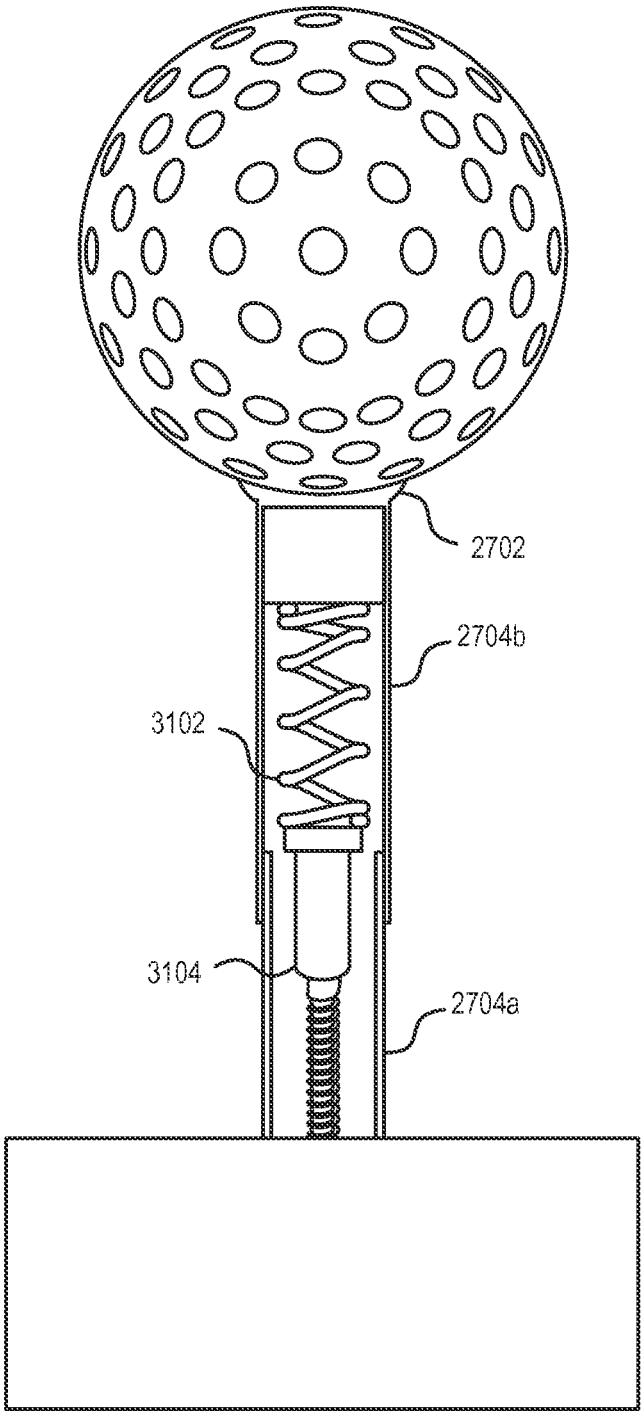
FIG. 31 illustrates an example embodiment of a resistance mechanism of a two part golf tee.

In some embodiments, the resistive force between the two parts of the two part golf tee may be provided by a spring force. FIG. 31 illustrates an example embodiment of a resistance mechanism of a two part golf tee. The resistance mechanism 2706 in the example of FIG. 31 may include, for example, a spring 3102 configured to provide a resistive force with which the support member 2702 resists downward pressure from the golf ball and a stiffness adjustment mechanism 3104 configured to adjust the stiffness of the spring 3102. Increasing or decreasing the stiffness of the spring 3102 increases or decreases the resistive force of the spring and the sliding of the first part 2704*a* relative to the second part 2704*b*. The increase or decrease in the resistive force adjusts the spin imparted to the golf ball by friction between the support member and the golf ball.

Figure 32:
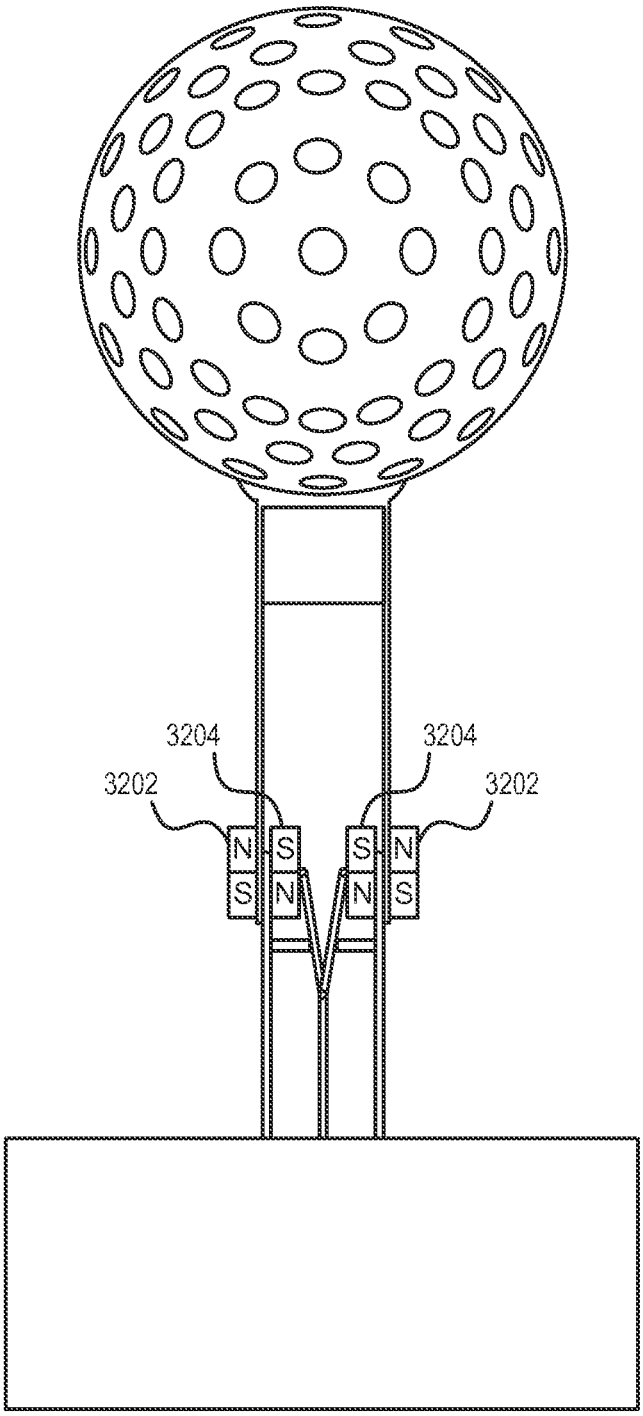
FIG. 32 illustrates an example embodiment of a resistance mechanism of a two part golf tee.

In some embodiments, the resistive force between the two parts of the two part golf tee may be provided by a magnetic force. FIG. 32 illustrates an example embodiment of a resistance mechanism of a two part golf tee. In one embodiment, the resistance mechanism 2706 in the example of FIG. 32 may include, for example, a plurality of magnets 3202 and 3204 configured to attract each other resulting in a resistive force to sliding of the first part 2704*a* relative to the second part 2704*b*. In one embodiment, increasing or decreasing the proximity of the interior magnets 3204 to the exterior magnets 3202 increases or decreases the resistive force. In other embodiments, the magnets 3202 and 3204 may be electromagnets and their magnetic fields may be adjusted to increase or decrease the resistive force. The increase or decrease in the resistive force adjusts the spin imparted to the golf ball by friction between the support member and the golf ball.

Figure 33:
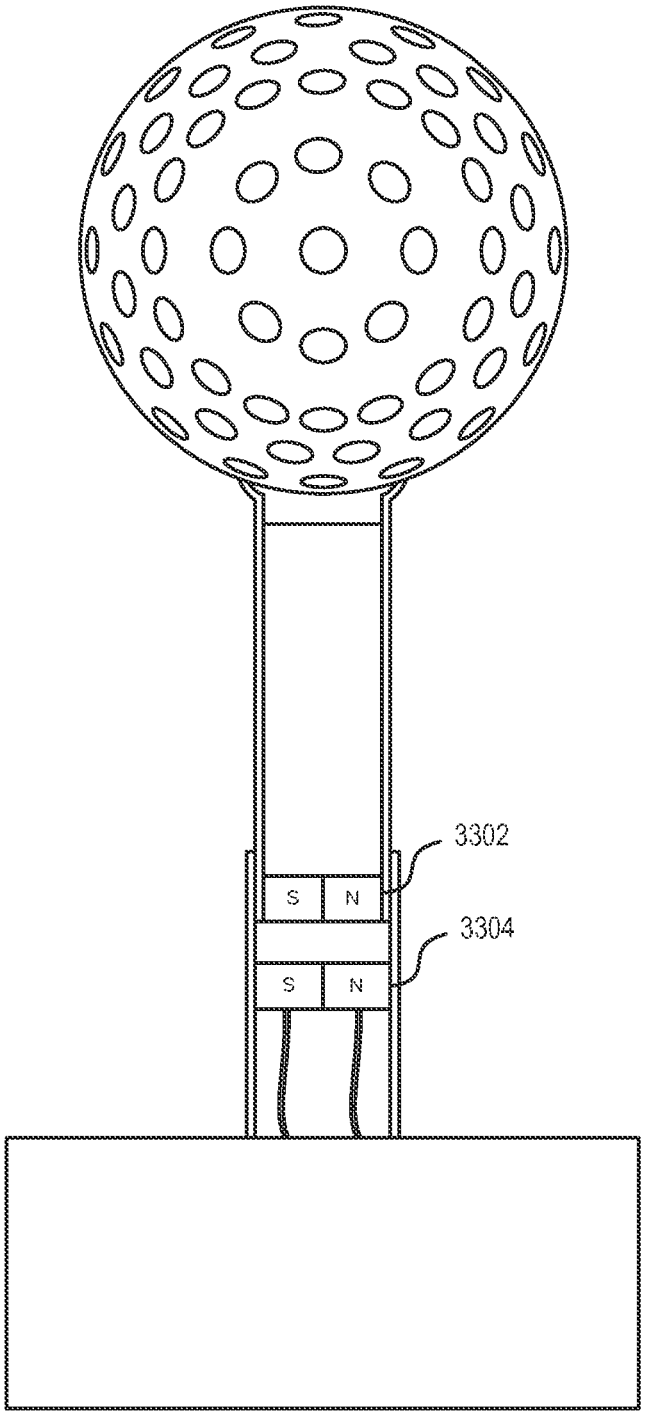
FIG. 33 illustrates an example embodiment of a resistance mechanism of a two part golf tee.

FIG. 33 illustrates an example embodiment of a resistance mechanism of a two part golf tee. In the example of FIG. 33, the resistive force to sliding of the first part 2704*a* relative to the second part 2704*b* may be provided by magnets 3302 and 3304 which are configured such that their magnetic fields repel each other. The magnets 3302 and 3304 may be electromagnets, for example, and their magnetic fields may be adjusted to increase or decrease the resistive force. The increase or decrease in the resistive force adjusts the spin imparted to the golf ball by friction between the support member and the golf ball.

Figure 34:
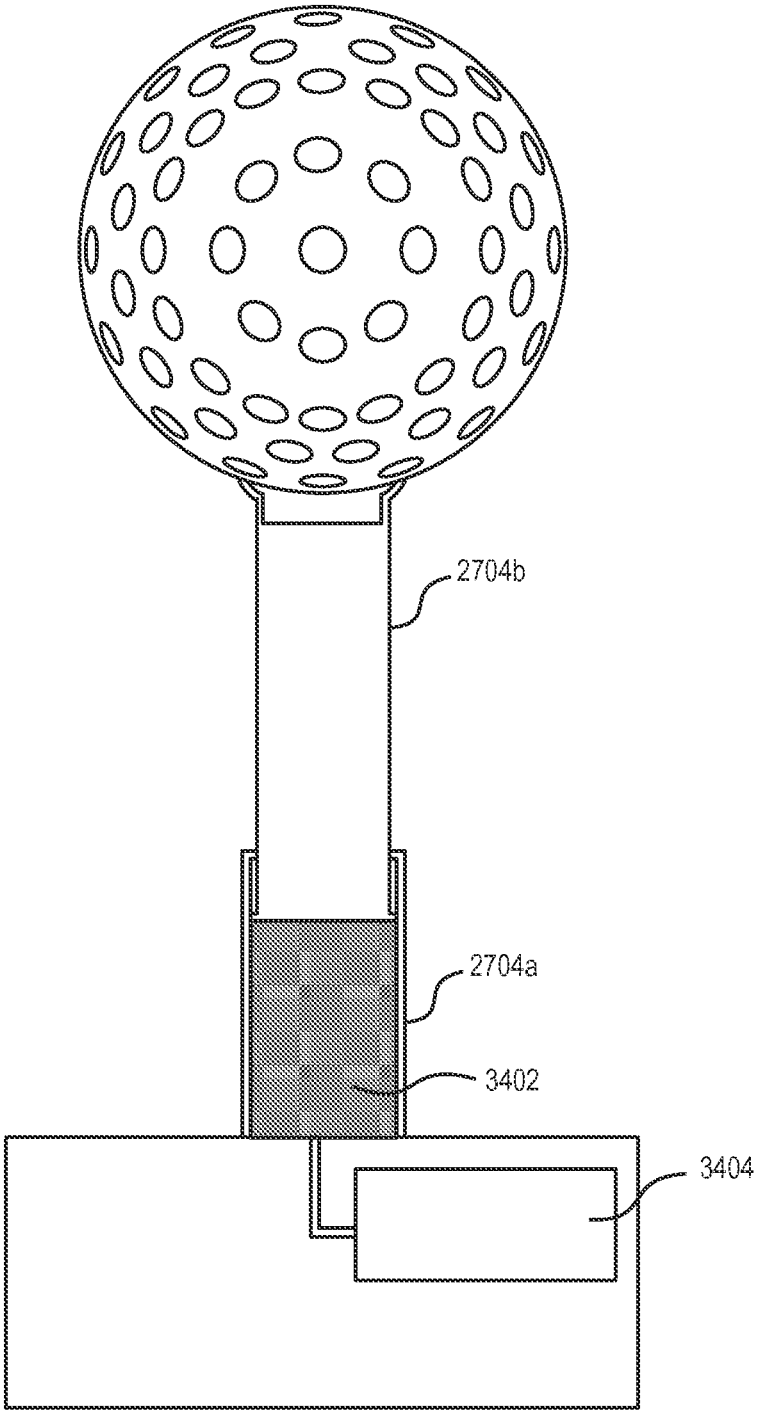
FIG. 34 illustrates an example embodiment of a resistance mechanism of a two part golf tee.

In some embodiments, the resistive force between the two parts of the two part golf tee may be provided by a fluid (e.g., a gas or a fluid) configured to resist downward pressure from the golf ball. FIG. 34 illustrates an example embodiment of a resistance mechanism of a two part golf tee. In the example of FIG. 34, the resistive force to sliding of the first part 2704*a* relative to the second part 2704*b* may be provided by fluid 3402. The pressure of the fluid 3402 may be regulated by pump 3404 to increase or decrease the resistive force. In another embodiment, the second part 2704*b* may include a controllable (e.g., in flow resistance, opening pressure, etc.) outlet port configured to open during the downward motion and expel a portion of the fluid, thereby controllably varying the resistive force. The increase or decrease in the resistive force adjusts the spin imparted to the golf ball by friction between the support member and the golf ball.

Figure 35:
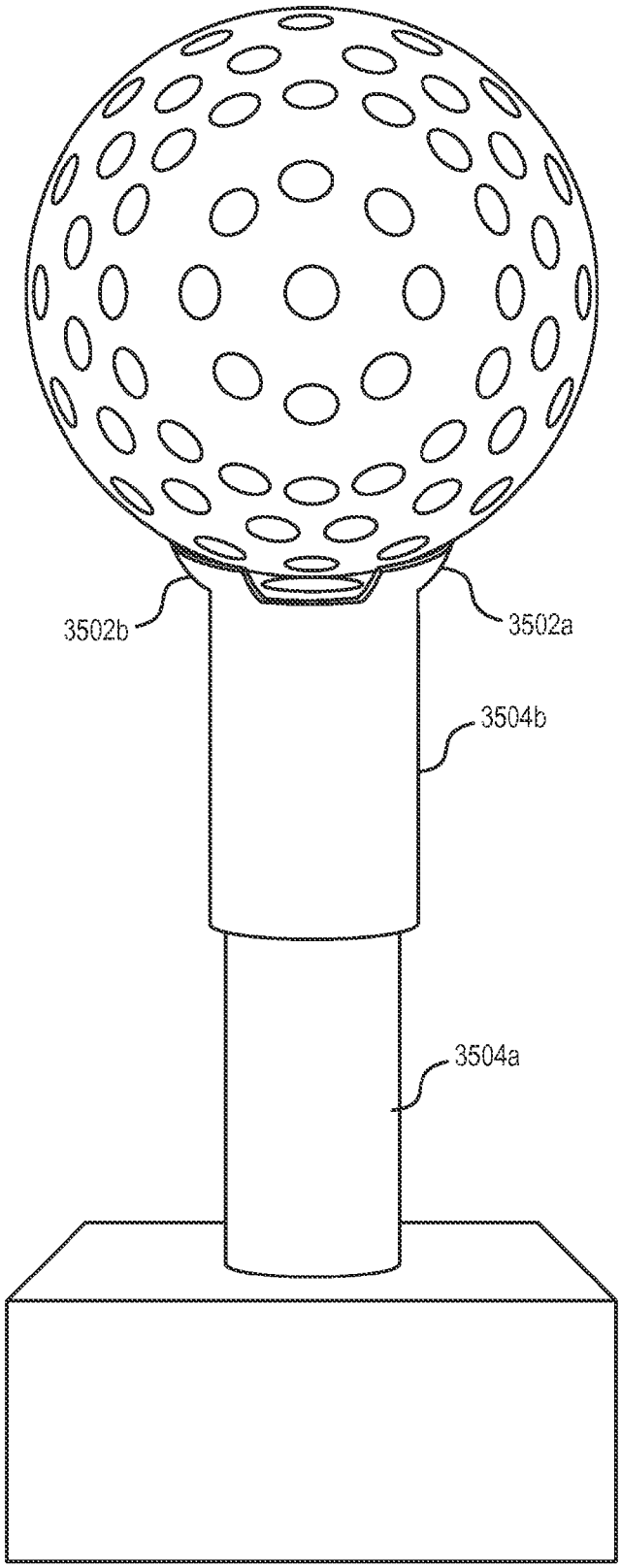
FIG. 35 illustrates an example embodiment of a two part golf tee with a plurality of asymmetrically distributed support members.

FIG. 35 illustrates an example embodiment of a two part golf tee with a plurality of asymmetrically distributed support members. In various embodiments, a two part golf tee having a first part 3504*a*, a second part 3504*b*, and an adjustable resistance mechanism (not shown) as described above with reference to FIGS. 27-34 may include a plurality of asymmetrically distributed support members 3502, as described above with reference to FIGS. 22-26. The two part golf tee with a plurality of asymmetrically distributed support members may provide greater control over the spin imparted to the golf ball due to frictional forces between the support members 3502 and the golf ball.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A golf tee for controlling frictional forces imparted to a golf ball comprising:

a shaft having an upper end and a lower end, the lower end configured to be inserted into or supported by an underlying surface; and a plurality of support members coupled with the upper end of the shaft, the plurality of support members configured to support a golf ball, wherein contact between the golf ball and the plurality of support members is asymmetrically distributed such that a first contact area with a first hemisphere of the golf ball is greater than a second contact area with a second hemisphere of the golf ball;

wherein each of the plurality of support members extends radially outward relative to the shaft; and wherein the plurality of support members comprises a first support member and a second support member, the first support member configured to contact the golf ball across a continuous arc of less than five degrees, the second support member configured to contact the golf ball across a continuous arc of between 30 degrees and 180 degrees.

2. The golf tee of claim 1, wherein the arc of the first support member and the arc of the second support member each form a portion of a circle.

3. The golf tee of claim 1, wherein a direction of spin imparted on the golf ball after impact with a golf club face due to friction between the support members and the golf ball is determined by an orientation of the support members when the shaft is inserted into or supported by the underlying surface.

4. The golf tee of claim 1, wherein the first support member is configured to contact the golf ball to form a first contact area that is between one square millimeter and three square millimeters, and the second support member is configured to contact the golf ball to form a second contact area that is greater than three square millimeters.

* * * * *